US011864650B2

(12) United States Patent
Forrest

(10) Patent No.: US 11,864,650 B2
(45) Date of Patent: Jan. 9, 2024

(54) WALL MOUNTABLE BOTTLE HOLDER

(71) Applicant: Francis R. Forrest, Wantirna South (AU)

(72) Inventor: Francis R. Forrest, Wantirna South (AU)

( * ) Notice: Subject to any disclaimer, the term of this patent is extended or adjusted under 35 U.S.C. 154(b) by 0 days.

(21) Appl. No.: 17/625,294

(22) PCT Filed: Jul. 9, 2020

(86) PCT No.: PCT/AU2020/000064
§ 371 (c)(1),
(2) Date: Jan. 6, 2022

(87) PCT Pub. No.: WO2021/003516
PCT Pub. Date: Jan. 14, 2021

(65) Prior Publication Data

US 2022/0257010 A1 Aug. 18, 2022

(30) Foreign Application Priority Data

Jul. 9, 2019 (AU) ..... 2019902433

(51) Int. Cl.
*A47B 73/00* (2006.01)
*A47F 7/28* (2006.01)
(Continued)

(52) U.S. Cl.
CPC ..... *A47B 73/002* (2013.01); *A47F 7/283* (2013.01); *A47B 81/04* (2013.01);
(Continued)

(58) Field of Classification Search
CPC ..... A47B 73/002; A47B 81/04; A47B 73/006; A47B 2220/0077; A47F 7/283;
(Continued)

(56) References Cited

U.S. PATENT DOCUMENTS 1,180,544 A * 4/1916 Sayer ..... A47F 7/283 211/85.26
1,835,726 A * 12/1931 Thompson ..... A47J 47/16 211/75
(Continued)

FOREIGN PATENT DOCUMENTS

WO 1998022927 5/1998
WO WO-9822927 A1 * 5/1998 ..... A47F 5/0823
(Continued)

OTHER PUBLICATIONS

PCT International Search Report and Written Opinion; Application No. PCT/AU2020/000064 Forrest, Francis R. International filing date of Jul. 9, 2020, dated Sep. 28, 2020, 8 pages.
(Continued)

*Primary Examiner* — Jennifer E. Novosad
(74) *Attorney, Agent, or Firm* — Patent Law Works LLP

(57) ABSTRACT

A kit for mounting a wall-mounted bottle holder adapted to hold a plurality of bottles in display formation. The kit comprises a fascia panel (10) and a plurality of bottle holders (20). The bottle holders (20) are formed from a rigid wire or rod elongate member. The bottle holders (20) are able to be moulded, drawn or bent into a shape to support a bottle. Using a block (40), the bottle holders (20) are mounted on the fascia panel (10) so that each bottle holder (20) extends outwardly from an exposed fascia surface (10A).

15 Claims, 16 Drawing Sheets

(51) Int. Cl.
*A47B 81/04* (2006.01)
*A47F 5/08* (2006.01)
*A47F 11/10* (2006.01)

(52) U.S. Cl.
CPC ..... *A47B 2220/0077* (2013.01); *A47F 5/0846* (2013.01); *A47F 11/10* (2013.01)

(58) Field of Classification Search
CPC ..... A47F 5/0846; A47F 11/10; A47F 7/28; A47F 5/08; A47F 5/0876; A47F 5/0006; A47F 5/0823
USPC ..... 211/75, 59.1, 94.01, 87.01
See application file for complete search history.

(56) References Cited

U.S. PATENT DOCUMENTS 2,128,114 A * 8/1938 Benedetti ..... A47G 29/24 211/75
2,529,287 A * 11/1950 Garwood ..... A47L 19/04 211/75
3,921,948 A * 11/1975 Long ..... A47J 47/16 211/75
4,863,131 A * 9/1989 Kinseley ..... A47F 7/285 248/220.41
5,397,006 A * 3/1995 Terrell ..... A47F 5/0846 211/74
5,499,724 A * 3/1996 Hickman ..... B25H 3/04 211/70.6
5,711,436 A * 1/1998 Moeller ..... A47G 23/0208 248/312.1
5,785,187 A * 7/1998 Lipman ..... A47F 5/0815 211/59.1
5,897,002 A * 4/1999 Carlino ..... A47F 5/0846 211/94.01
6,311,854 B1 * 11/2001 Anderson ..... A47F 5/0846 248/225.11
6,393,877 B1 * 5/2002 Church ..... A47F 5/0846 70/57
6,749,161 B1 * 6/2004 Will ..... B25H 3/04 248/222.51
6,808,147 B2 * 10/2004 Brannen ..... A47J 47/20 248/316.1
6,945,414 B1 9/2005 Stevens et al.
7,284,671 B1 * 10/2007 Doscher ..... A47B 81/005 211/32
D655,986 S * 3/2012 Schneider ..... D8/380
8,573,548 B2 * 11/2013 Kuhn ..... A47F 5/0815 248/314
8,607,994 B1 * 12/2013 Schneider ..... A47B 73/002 211/106.01
9,149,115 B2 * 10/2015 Kasza ..... A47F 5/0823
10,165,872 B2 * 1/2019 Jones ..... A47F 5/0823
10,441,075 B2 * 10/2019 Kasza ..... A47F 5/0823
10,448,735 B2 * 10/2019 Carpenter ..... A47B 73/00
10,737,836 B2 * 8/2020 Carpenter ..... B65D 23/12
2001/0013567 A1 * 8/2001 Valiulis ..... A47F 5/0861 248/220.31
2003/0160060 A1 * 8/2003 Hornblad ..... A47F 5/08 221/256
2004/0069730 A1 * 4/2004 Woods ..... A47B 73/00 211/74
2006/0202096 A1 * 9/2006 Mazzola ..... A47F 7/283 248/316.7
2007/0068887 A1 * 3/2007 Richard Nawrocki ..... A47F 5/0807 211/171
2009/0071924 A1 * 3/2009 Decker ..... A47B 73/002 211/88.01
2010/0051769 A1 * 3/2010 Tyson ..... A47F 5/0807 248/220.31
2011/0132853 A1 * 6/2011 Drobot ..... A47F 5/0853 211/183
2011/0309220 A1 * 12/2011 Collini ..... A47F 7/28 248/311.2
2012/0117910 A1 * 5/2012 Chuang ..... A47B 96/20 52/588.1
2016/0007743 A1 * 1/2016 Koder ..... A47B 73/002 211/74
2016/0331131 A1 * 11/2016 Ghaeni ..... A47F 5/0823
2021/0259411 A1 * 8/2021 Fratilla ..... A47B 57/46
2022/0257010 A1 * 8/2022 Forrest ..... A47F 7/283

FOREIGN PATENT DOCUMENTS

WO 2014032158 A1 3/2014
WO WO-2014032158 A1 * 3/2014 ..... A47B 47/00
WO WO-2021003516 A1 * 1/2021 ..... A47B 73/002

OTHER PUBLICATIONS

PCT International Preliminary Report on Patentability with Ch. II Demand, Application No. PCT/AU2020/000064 Forrest, Francis R. International filing date of Jul. 9, 2020, Authorised Officere Eng Wei Soo, Australian Patent Offie, dated Sep. 8, 2021, 10 pages.

* cited by examiner

WALL MOUNTABLE BOTTLE HOLDER

CROSS REFERENCE TO RELATED APPLICATIONS

This application is a national phase entry under 35 U.S.C. § 371 of International Patent Application PCT/AU2020/000064, filed Jul. 9, 2020, designating the United States of America and published in English as International Patent Publication WO 2021/003516 on Jan. 14, 2021, which claims the benefit under Article 8 of the Patent Cooperation Treaty to Australian Patent Application Serial No. 2019902433, filed Jul. 9, 2019, the entireties of which are hereby incorporated by reference.

FIELD OF INVENTION

This invention relates to a wall mountable holder. More particularly, this invention relates to a wall mountable bottle holder and system therefor.

BACKGROUND ART

The following references to and descriptions of prior proposals or products are not intended to be, and are not to be construed as, statements or admissions of common general knowledge in the art. In particular, the following prior art discussion should not be assumed to relate to what is commonly or well known by the person skilled in the art, but to assist in the inventive process undertaken by the inventor (s) and in the understanding of the invention.

Prior wine racks have been described which have a floor mounted storage cabinet with minimal view of each bottle of wine and taking up floor space, which can be limited in modern dwellings.

Other more recently described wall mounted wine racks have been described as having individual bottle support arms extending perpendicular from an elongated vertical panel that support a bottle between them.

If existing wall mounted racks are installed in exposed areas and at head height, rod ends, if exposed, can offer a safety hazard to humans (particularly to unprotected eyes).

With existing wall mounted wine racks there is a large load applied to the supporting rods by the downward pressure of the bottle weight. Old methods of fixing the extended perpendicular arm to the elongated vertical panel involve providing particularly thick arms of a significant size, which have the affect of obstructing the visual view of the bottle.

Other existing wall mounted racks have been described with individual bottle support arms that extend perpendicularly from an elongated vertical panel and the bottles are aligned transverse to the arms, being positioned horizontally and parallel to the elongated vertical panel. In such a prior art arrangement, one arm supports a base section of the bottle and a second arm supports a neck portion of the bottle. However, as bottles vary considerably in base to neck dimensions, only one diameter size of bottle can be held in a true horizontal position once a predetermined positioning of the arms is set.

An object of the present invention is to ameliorate one or more of the aforementioned disadvantages of the prior art or to at least provide a useful alternative thereto. Another object of the invention may be to provide an attractive, modern, modular, add on wine rack system that both stores and displays each wine bottle with minimal obstruction and maximum view of each bottle displayed. Another aim may include providing different display options for the unique bottle holder and accompanying system comprising bottle holders that may be in the form of wine bottle support brackets. Still another aim may be to provide a bottle display system that, due to its simplicity in the way that the bottle holder support brackets are mounted, the size, shape and bottle volume of fascia panels supporting the brackets is not restricted. Another object of the invention may be to provide a method for mounting an array of bottle holders that is simple to install and has minimal components that do not require skilled labour to install.

STATEMENT OF INVENTION

The invention according to one or more aspects may be as defined in the independent claims. Some optional and/or preferred features of the invention are defined in the dependent claims.

Accordingly, in one aspect of the invention there is provided a wall mountable holder including:

A kit for mounting a wall-mounted bottle and/or glass holder adapted to hold a plurality of bottles in display formation, the kit comprising:

- a fascia panel; and
- a bottle and/or glass holder (bottle holder) formed from a rigid wire or rod elongate member able to be moulded, drawn or bent into a shape to support a bottle and/or glass and to be mounted on the fascia panel so that the bottle holder extends outwardly from an exposed fascia surface, wherein the kit further comprises:

- a template to guide a user to locate a plurality of holes for securing a corresponding plurality of fasteners to a substrate; and
- a block for facilitating the mounting of the bottle holder to the fascia panel, the elongate member terminating substantially co-extensively at free ends and joined at a remote end by a loop or a U-shaped bridge, the elongate member comprising a pair of elongate sections extending substantially parallel to each other and together with the bridge adapted to support a bottle and/or glass of any one of a variety of sizes in substantially horizontal alignment; and the removable block adapted to support the elongate side sections, and to resist their bending or to maintain their linear integrity, whilst force is applied to the bottle holder in the direction of the free ends and substantially parallel to the longitudinal axes of the elongate sections.

Template

The template may be in the form of a cut-out, moulded or stamped sheet or plate. The template may comprise a plurality of connected bars or plates. The template may be made of metal sheet, timber, moulded or pressed and bonded particulate cellulosic material, fibre-board, glass fibre or another panel material. Preferably, the template is in the form of a plate, sheet or panel. The template may be flexible. The template may be sufficiently rigid when planar to definitely space one portion of the template from another portion in the plane of the template.

The template may include pilot holes to facilitate the location and formation of the holes for the fasteners. The template may include indicia, such as distance measurements and positioning indicators, to enable the user to locate holes for fasteners within the substrate.

The template may have a keyed edge. The keyed edge may be in the form of a recess. The keyed edge may be in the form of a protruding profile. The template may be a first template and may be adapted to register with a second template to enable further locations to be formed for mounting fasteners to the substrate.

The template may include two or more templates. The templates may be identical or may vary in size and shape. The templates may be adapted to engage in specific relationship to each other, such as in particular adjacent orientations whereby to provide mounting options by positioning of the fasteners in desired arrays and areas for the fascia panel(s).

Mounting Plate

The kit may further comprise a mounting plate. The mounting plate may form a layer between the fascia panel and the substrate.

The use of multiple first, second, and so on, templates may permit the mounting of an array of fascia panels to the substrate, either directly or with a second substrate interposed as a mounting plate between the fascia panel and the first substrate. The recess may be defined by curved edges, or may be rectangular or another polygonal shape, sufficient to facilitate the alignment of an adjacent mounting plate adjacent thereto, either in the same orientation, or at a limited number of different angles thereto, e.g. by engaging a male rectangular key in a polygonal-shaped recess. Preferably the recess is rectangular and complementary to rectangular protrusions of adjacent mounting plates. However, a sharp- or right-angled corner may form a male key member, and be receivable in a correspondingly shaped recess. The recess may be truncated and may not extend the full depth of the mounting plate layer. The male key may be similarly truncated in terms of its depth dimensions to complement the shape of the truncated recess of an adjacent mounting plate.

The substrate may be the wall or a panel adapted to overlay a portion of the wall.

The substrate may be a first substrate. The mounting panel may be used to support the fascia panel in a mounted position where specific load bearing zones, such as wall studs, in the first substrate, do not register with predetermined engagement devices for fasteners in the fascia panel. Therefore, although load-bearing studs may be aligned in a location that does not allow direct mounting of the fascia panel to the first substrate by using the load-bearing features, by mounting the second substrate in the form of the mounting plate to the first substrate in line with existing load-bearing zones, the fascia panel may be mounted to the mounting plate at a more desirable position.

The template and the mounting plate (backing plate) may form part of the same device, namely a mounting template. The mounting plate may be suitable for creating a secondary substrate that provides an intervening layer between the first substrate and the fascia panel. The fascia panel may be mounted directly to the mounting plate, which in turn is mounted to the first substrate.

The mounting plate may include two or more mounting plates. The mounting plates may be identical or may vary in size and shape. The mounting plates may be adapted to engage in specific relationship to each other, such as in particular adjacent orientations whereby to provide mounting options in desired shapes and areas for the fascia panel(s). The mounting plates may have one or more keyed edge features that complement and engage with corresponding one or more features on the edges of like or complementary mounting plates positionable adjacent the mounting plate.

Fascia Panel

The fascia panel is preferably sufficiently thick to receive the free ends of the bottle holder embedded therein. The fascia may comprise at least a layer that has malleable properties to enable the free ends to be reversibly inserted and mounted into the malleable layer. However, advantageously, the fascia panel has preformed holes in a desired array to receive the free end pairs of a plurality of bottle holders The fascia panel may also have, on its rear side, at least one pre-formed recess in the form of a keyhole that is adapted to receive a mounting fastener head. The keyhole may open into a broader cavity for receiving the head of a fastener, and a narrower neck region whereby to trap the head and receive the narrower shaft of a fastener. The keyhole may be one of a plurality of keyhole mounting recesses. The keyhole recesses may form part of an array of mounting points for the fascia panel. Preferably, there are at least 3 mounting points on each fascia panel that are adapted to register with the fastener heads installed according to the kit form of the invention.

The fascia panel may include two or more fascia panels. The fascia panels may be identical or may vary in size and shape, and bottle holder orientation.

Block

The block may comprise a pair of rigidly joined and spaced channels adapted to receive portions of the elongate sections. The block may be in the form of a substantially rectangular body.

The block is adapted to partially structurally support, or partially enshroud or encase at least the portion of the bottle holder not including the free ends. The block may be adapted to structurally support, or partially enshroud or encase at least the elongate sections. The elongate sections may extend in parallel and spaced relationship whereby to define a channel therebetween. The channel may be a bottomless channel in that the elongate sections are adapted to grip or support at least a portion of the length of a side of a bottle against gravity.

Using the block to mount the bottle holder to the fascia panel may be effective to reduce the diameter of the elongate member compared to existing racks, by as much as 50%, or more if the prior art comparison is of a rectangular or similar structure. However, the bottles may be displayed in the same manner as described herein using larger diameter wire/rods.

Bottle Holder

The elongate sections may be side sections. The spacing therebetween may be less than the diameter or width of a bottle to be supported. The block may be adapted to receive, structurally support, or partially enshroud or encase the bridge, so that the spaced channels are correspondingly joined by a connecting curved recess to correspond to a curved bridge.

The elongate member bottle holder may be formed with one continuous length of rigid wire or rod.

Expressed another way, each bottle holder may have a parallel-sided base comprising a pair of arms that join at a remote end in a loop or bend to present a smooth broad structure that does not form a poking hazard.

The bottles may be aligned in a true horizontal position to provide a more pleasing visual display. However, the bottles holder may be adapted to display the bottle in an inclined or vertical drop position. Each free end may extend along a longitudinal axis that is inclined relative to the longitudinal axis of the elongate section with which it is continuous. There may be a bend joining the free end and the elongate section with which it is continuous having an angle theta that is in the range 0-90°, preferably about 0°, 20° or 70°.

Interposed between the free end and its associated elongate section, there may be a Z-section including an initial bend that is about 90°, so that the interposed Z-section includes an initial section that depends downwardly from the free end that is adapted to be received in a bore in the fascia panel that is aligned substantially normal to the general plane of the fascia panel. The Z-section may further include a substantially horizontal middle section spacing the initial section from the free end to provide spacing to accommodate the neck of a bottle inclined in a generally upwardly orientation with the neck inclined toward the fascia panel. The elongate section may extend from the middle section at one of a variety of desired inclinations at the angle theta.

The bottle may include a wine, spirit, or other bottle type. Preferably, the bottle includes wine bottles. Standard wine bottle sizes vary between 70 mm and 90 mm, most typically 75 mm in diameter, and are generally between 290-300 mm long. The main body of the bottle is between 195 mm and 220 mm.

Fasteners

The fasteners may comprise a single type of fastener adapted to penetrate a load-bearing zone, such as a timber structure, including a wall stud, of the substrate. The fastener may have a shaft sufficiently long to define a gap along the length of a shaft of the fastener. The gap may be between the underside of a head of the fastener and the outermost surface of the substrate or the second substrate.

The fasteners may be in multiple parts, for example where the substrate is a non-structural material such as plasterboard wall. In such a case, a bore may be provided or formed by a plasterboard anchor should be installed in each required hole location in the non-structural material substrate. Screw fasteners may then be installed through registering bores through the second substrate to mount the second substrate to the target wall.

Further fasteners may then be provided in the form of partially sunk screws with broad heads, which may be received with in the keyhole recesses in the rear face of the fascia panel whereby to mount same. The fasteners may include spacers or the fasteners may restrain the spacers. The spacers may include hollow cylindrical sleeves with flanges or other substantially cylindrical parts. The spacers may include cone shaped or truncated cone portions. The spacers may include washers. The spacers may be made of materials including metal, plastic and wood. Preferably, the spacers include cylindrical sleeves with flanges.

Stemmed Glass Holder

Another aspect of the invention may provide a wall mountable holder including a kit for mounting a wall-mounted stemmed glass holder adapted to hold a plurality of stemmed glasses in display formation, the kit comprising:

a fascia panel; and a stemmed glass holder formed from an elongate member able to be moulded, drawn or bent into a shape to support a stemmed glass and to be mounted on the fascia panel so that the stemmed glass holder extends outwardly from an exposed fascia surface, wherein the kit further comprises:

a template to guide a user to locate a plurality of holes for securing a corresponding plurality of fasteners to a substrate, the elongate member terminating substantially co-extensively at free ends and having a cradle intermediate the length of the elongate member, the elongate member including an elongate section extending away from the fascia surface and, together with a bridge, adapted to support a stemmed glass of any one of a variety of sizes in substantially vertical alignment; and supported ends of the elongate members including features which are adapted to slot into a channel in the fascia panel.

The features may include a flat elongate member, L-shaped hooks, elongate beams with cross-section in the shape of a rectangle, T, L, cruciform, circular or oval and other features. The fascia panel may include multiple channels. Preferably, the fascia panel includes one channel.

The channels may include cross-sections in the shape of a T, L, cruciform, circular, oval and other shapes. Preferably, the features include elongate plates with a cross-section in the shape of a rectangle. Preferably, the channels include a T-shaped cross-section. The channels may extend part way through the fascia panel. Preferably, the channels extend all the way through the fascia panel.

The elongate section may include threaded supported ends, which screw into the features. The elongate section may be bolted to the features. The elongate section may hook in/onto the features or otherwise interlock with the features. Preferably, the elongate section is welded to the features.

The free ends may be parallel with the elongate section. Preferably, the free ends include a hook or bend. Preferably, the bend has an angle between 60 and 90 degrees.

The success of the proposed system relies on exceptional accuracy. The drilling of the bottle holder receiving holes into the fascia panel is adapted to achieve accurate hole spacing, horizontal and vertical alignment, normal or virtually 90 degree angle entry into the fascia panel surface and no variation in the diameter of the drilled hole. Prior art arrangements require specialised manufacturing equipment such as industrial drilling machines or CNC routers, requiring specialised trades people to programme and operate.

This invention enables an unskilled, lay or semi-unskilled do-it-yourself (DIY) person to manufacture a product of the invention, namely a specialised wine display. This invention allows the DIY person, or skilled person with ease, to manufacture a wine display for a home, cellar, restaurant, wine bar, winery with cellar door sales or liquor store fit out, with a much reduced cost when compared to purchasing a commercially manufactured product of similar build quality.

In another aspect of the same invention, there is provide a composite DIY template comprising a drilling jig, spacing/positioning template and/or a bottle holder insertion block. The composite DIY template can be made from such materials as wood or soft metals, the thickness of such a template will be greater than the total depth of the hardened drilling bush component.

The composite DIY template include a drilling component, a spacing/positioning component, as well as a bottle holder insertion block. The composite DIY template may comprise a drilling component containing two or more, specially designed, hardened drilling bushes that are designed to press fit into soft materials, such as wood and soft metals.

The top section of the bush may have a serrated surface that has a greater diameter than the ground surface of the lower section of the bush. The accurately drilled vertical receiving hole in the template is preferably the same diameter or marginally smaller than the ground lower section of the bush. This hole may extend beyond the depth of the drilling bush to the lower edge of the composite template, which extends beyond the depth of the drilling bush. As the diameter of the extended drilling bush hole is greater than the diameter of the drill bit, a void is formed to receive excess swarth gathered through the drilling process This is with the aim of ensuring that the excess swarth does not dislodge the composite template through the drilling process.

The top serrated surface of the bush may prevent rotational movement and increased axial resistance when inserted in the jig. The internal diameter of the hardened bush is preferably the same diameter or marginally larger than the selected drilling bit, the diameter of which is preferably the same, or still more preferably a smaller diameter, than that of the chosen bottle holder(s).

The depth of the drilling bush is preferably of sufficient length to ensure that the drill bit will be guided in a true vertical direction. The exactness of the internal diameter of the bush relative to the drilling bit is adapted to ensure that the drilled hole is of a consistent and accurate diameter.

The composite DIY template may also provide a facility for accurate bottle holder hole positioning. The bottle holder advantageously has two free ends that may be manufactured to a specific spacing. The drill bushes are preferably placed in such a spacing that the holes therefor drilled into the facia panel will readily accept the free ends of the bottle holder bracket.

The bottle holder holes preferably assume a virtually precisely horizontal position, not only relative to each other, but also to the other bottle holders and their bottles retained thereon. The bottles are adapted to be displayed in the layout, whereby the corresponding positioned drill bushes ensure such positioning is accurate.

Each bottle position is accurately and evenly spaced throughout the layout. The positioned recesses in the composite DIY template(s) are adapted to ensure that each bottle in both the horizontal or vertical plains is evenly positioned throughout the total layout.

The insertion block may also be included into the composite DIY template which offers a further cost-advantage and assembly efficiency to the user. The DIY person, home or commercial builder may use the invention to design their own layout positioning of wine bottles in their layout design. A free hand template is preferably included, comprising the drilling and bottle holder spacing to aim for excellent precision and accuracy of the composite DIY template, whilst allowing for a free hand in bottle positioning. To further assist the free hand bottle positioning, each template may be shaped to replicate the chosen bottle holder layout. If the design requires the bottle base to be perpendicular to the fascia, the template shape is adapted to image the largest bottle base diameter with the two bottle holder reception holes in the correct position, allowing the designer to position and or trace each chosen bottle position. If the designer requires the bottle to be horizontal to the fascia panel, the free hand template is adapted to image the shape of the largest bottle to be displayed with the bottle holder receiving holes placed in the correct position, allowing the designer to position or trace each chosen bottle position. The lower edge of each free hand template is preferably adapted to provide a horizontal plain for the designer to maintain horizontal accuracy in their layout.

The template in the form of a block may be adapted to support the bottle holders as they are inserted into the holes in the facia panel. The bottle holders may be press fit into the facia panel while the block keeps spigots of the bottle holders coaxial with the holes in the facia panel. Advantageously, this may protect the holes from damage due to misalignment of the spigots with the holes as the bottle holders are inserted into the holes in the facia panel. The block may be supplemented with additional hardened drilling bushes which are used as templates to accurately space the holes in the facia panel from each other. The drilling bushes may include internal dimensions to closely fit a drill bit of the correct size for the holes in the facia panel. Hardened drilling bushes may be located in bush holes that are offset from a front face of the facia panel. The offset preferably creates a gap between the hardened drilling bushes and the front face of the facia panel when drilling the holes in the facia panel with the drill bit. Recesses may be used to position the template or block on the positioned holders in order to accurately drill the next positioned bottle holder holes. The recesses may be located at the edges of the block or template and may extend transversely relative to the general plane of the template or block. The gap may be useful to provide space to receive sawdust resulting from drilling of the holes. The hardened drilling bush may be adapted to maintain the drill bit at a 90 degree angle to the front face of the facia panel during drilling. The block may further include an alignment recess which is adapted to line up with an edge of the facia panel for positioning of the template or block during drilling of the holes.

It will be appreciated that any of the features described herein can be used in any combination, and that the invention as described in respect of the second aspect may have the specific features referred to above in respect of the invention as described in respect of the first aspect.

BRIEF DESCRIPTION OF THE DRAWINGS

The invention may be better understood from the following non-limiting description of preferred embodiments, in which.

DETAILED DESCRIPTION OF THE DRAWINGS

Figure 1:
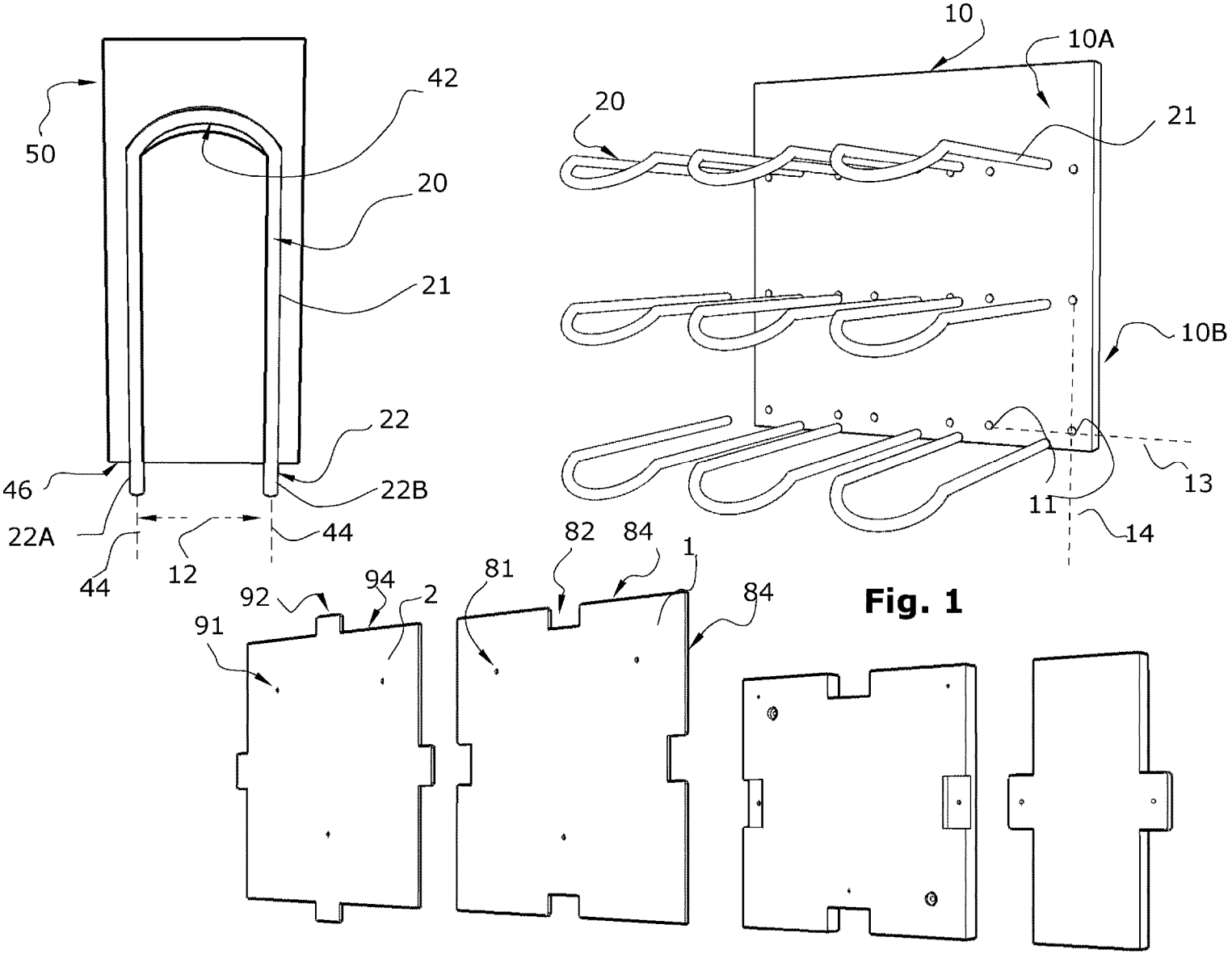
FIG. 1 is an exploded view of a kit for mounting a wall-mounted wine bottle holder according to a first embodiment of the invention.

Preferred features of the present invention will now be described with particular reference to the accompanying drawings. However, it is to be understood that the features illustrated in and described with reference to the drawings are not to be construed as limiting on the scope of the invention. In describing the various embodiments of the invention, like features will be referred to using like references, with references for features of each embodiment generally preceded by 1, 2, 3, or followed by a Roman numeric sequence, such as i, ii, iii, etc. or an alphabetical sequence such as a, b, c, relative to the corresponding feature of the first embodiment. For example, a feature 10 of the first embodiment may represented as 110, 210, 310, or 10*a*, 10*b*, 10*c*, or 10*i*, 10*ii*, 10*iii*, etc. in second, third and fourth embodiments, respectively.

The drawings show a kit for mounting a wall-mounted bottle holder adapted to hold a plurality of bottles in display formation. The kit comprises a fascia panel (10) and a plurality of bottle holders (20). The bottle holders (20) are formed from a rigid wire or rod elongate member.

The bottle holders (20) are able to be moulded, drawn or bent into a shape to support a bottle. Using a block (50), the bottle holders (20) are mounted on the fascia panel 10 so that each bottle holder (20) extends outwardly from an exposed fascia surface (10A). The facia surface (10A) (exposed facia surface) may include a decorative pattern or texture. The facia surface (10A) may include wood, faux wood, faux marble or other faux rock, leather, faux leather, paint, metal and other materials. The facia surface (10A) may include engraved, etched or carved surfaces. The facia surface (10A) may be engraved or carved by hand or with a machine such as a CNC (computer numerical control) machine.

The kit further includes a first template to guide a user to locate a plurality of holes for securing a corresponding plurality of fasteners to a substrate, such as a wall. A user employs the block (50) to facilitate the mounting of the bottle holder to the fascia panel (10).

The elongate member terminates substantially co-extensively at free ends and is joined at a remote end by a loop or a U-shaped bridge. The elongate member includes a pair of elongate sections extending substantially parallel to each other. Together with the bridge, the elongate sections of each bottle holder are adapted to support a bottle of wine of any one of a variety of sizes in a predetermined horizontal or inclined alignment.

The block (50) is for temporary use as a means to install the bottle holders in or on the fascia panel (10) and is removable. The block (50) is preferably adapted to support the elongate side sections (21), and to resist their bending or to maintain their linear integrity, whilst force is applied to the bottle holder (20) in the direction of the free ends (22) and substantially parallel to the longitudinal axes of the elongate sections (21).

The elongate sections (21) may be bent at an angle theta relative to the free ends (22) to achieve a bottle holder support structure that is inclined to the horizontal.

FIG. 1 shows an exploded view of a kit for mounting a wall-mounted bottle holder comprising, from left to right, the block (50) and the bottle holder (20), the fascia panel (10), a first template, a second template, a first mounting plate and a second mounting plate.

The fascia panel (10) is a bottle rack comprising of an elongated (vertical) panel of solid construction. The fascia panel (10) is a solid construction and may be made of MDF, chipboard, plywood, timber, acrylic or aluminium.

A pair of horizontal holes (11) are shown to align in a horizontal plane (13) and have a width (12). The holes (11) are adapted to receive the free ends (22) of the bottle support (20). The bottle holder (20) has substantially parallel elongate sections (21) that terminate in the free ends (22). The holes (11) can be drilled through the first face (10A) and second face (10B) of the elongated fascia panel (10) or may stop short of penetrating the second face (10B). To ensure that the free ends (22) are tightly fitted in the holes (11), the diameter of the holes (11) are preferably sized to be equal to or less than the diameter of the free ends (22) of the bottle support bracket arms, each separately designated 22A or 22B.

The bottle holder (20) is inserted into the holes (11) of the fascia panel (10) by housing the bottle holder (20) in a dedicated recess or groove (42) so that it is supported against axial movement in the direction of the longitudinal axes (44) of the elongate sections (21), with the free ends (22) projecting beyond the extent of a remote end (46) of the block (50). To urge the free ends (22) into the holes against frictional resistance, the block (50) housing the bottle holder (20) in the recess (42) may be forced towards the surface (10A) with the free ends (22) in registration with the holes (11). An impact from the likes of (but not restricted to) a mallet or hammer may be advantageous to force the free ends (23,23A) into the elongated panel holes (11).

The holes (11) are spaced apart proportionally in both the horizontal (13) and vertical (14) planes, to accommodate, in the shape and dimensions of the bottle holder (20), most commercially available wine bottles, including French champagne bottles. All of the variously shaped and oriented bottle support brackets shown in FIGS. 3-7 are configured to support commercially available wine bottles in all of their shapes and sizes. The bottle support brackets shown in their various configurations in FIGS. 3-7 are examples of bottle holders according to the invention that can hold bottles in different formats.

Figure 4:
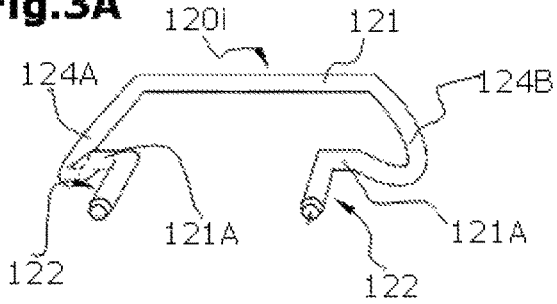
FIGS. 4 and 4A are perspective views of a bottle holder according to a second embodiment of the invention.
Figure 4A:
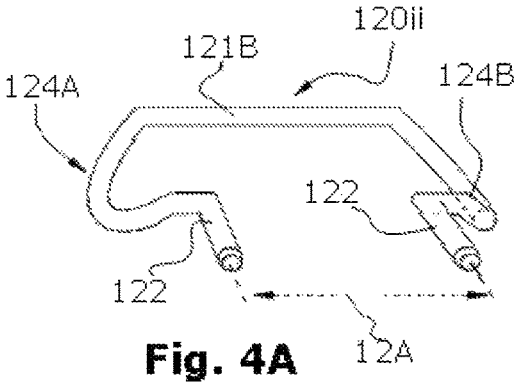

All formats of the bottle holder (20) and fascia panel (10) installation process require a similar procedure, noting that in the arrangements shown in FIG. 4A, where the bottles are aligned parallel to the surface 10A and the free ends extend of an elbow joining the loop section to the free end, the hole spacing (12A) is further apart.

Figure 2:
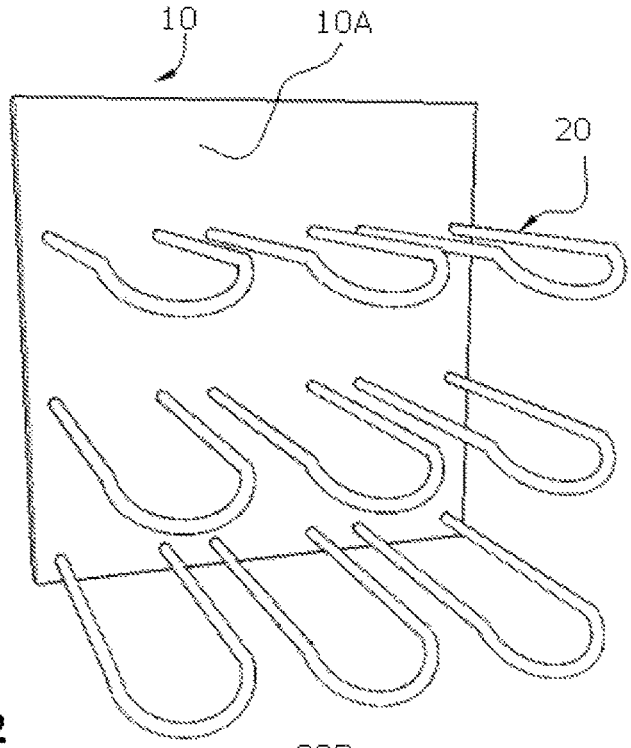
FIG. 2 is a perspective view of a facia with bottle holders of the wall-mounted wine bottle holder according to the first embodiment of the invention.
Figure 3:
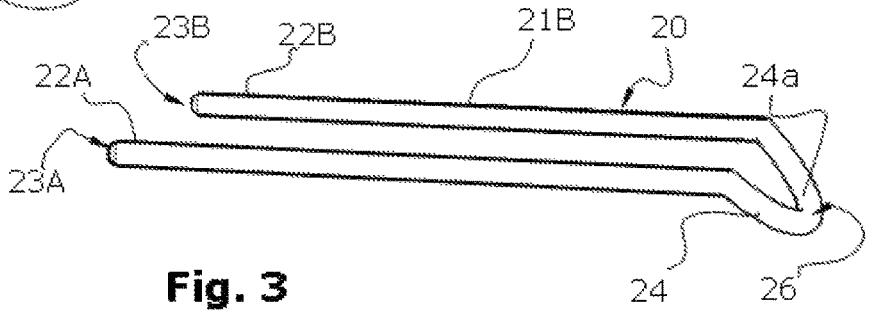
FIG. 3 is a perspective view of one of the bottle holders according to the first embodiment of the invention.
Figure 3A:
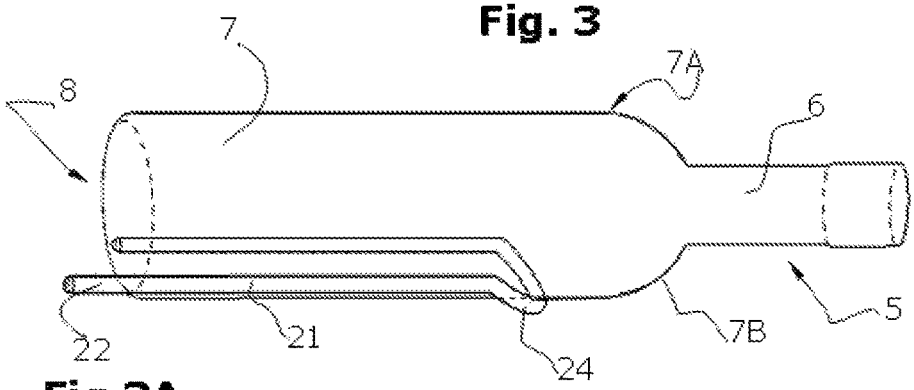
FIG. 3A is a front view of one of the bottle holders supporting a bottle.

In a first preferred form of the bottle holder (20), the bottles are held substantially horizontally with the bottle holder (20) shown in FIGS. 2-3A aligned such that the longitudinal axes (44) extend substantially perpendicular to the surface (10A) with the bottlenecks pointing away from the fascia panel (10).

As shown in FIGS. 3 and 3A, the bottle holder (20) comprises an elongated section or element (21) having a first tapered end (21A) and a mirrored second elongated element (21B) that is substantially parallel to the first elongated element (21A), each elongated section (21A,B) having corresponding tapered first and second ends (23A,B).

The first elongated element (21A) is joined to the second elongated element (21B) by the loop (24). The loop is in the form of an arc. Where the bottle (5) may be defined as having a neck (6) and a main body portion (7), the loop (24) is dimensioned to support an end (7*b*) of the main body (7) remote from the bottle's base (8). The loop (24) is therefore adapted to be within the length of the main body of the bottle.

The two elements (23A,B) are separated by less than the width of a standard 700-790 mm wine bottle, whose main body (7) has parallel sides and being wide enough apart so the main body (7) of the wine bottle can cradle between the first and second elements (21A,B) as shown in FIG. 3A The cradle, loop or arc (24) joining the elongate side elements (21A,B) is angled in a downward direction to a degree where it will not be in supportive contact with the main body (7) of a standard 700 mm wine bottle (5) (although larger bottles are also accommodated) when in its cradle position. However, the elongate side sections (21A,B) are spaced to support the load of the bottle (5) along a substantial length of the main body (7), the top surface (24A) of the loop (24) optionally being in contact and providing some stability and support, but not the bearing the primary load of the bottle (5).

Figure 5:
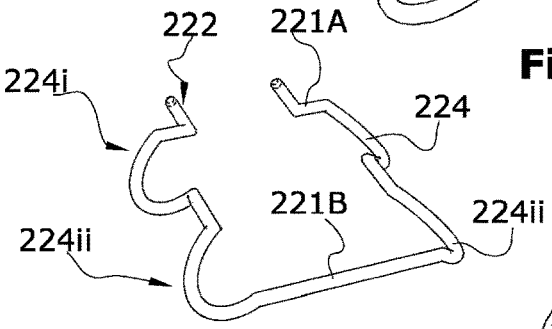
FIG. 5 is an upper perspective view of a bottle holder according to a third embodiment of the invention.
Figure 5A:
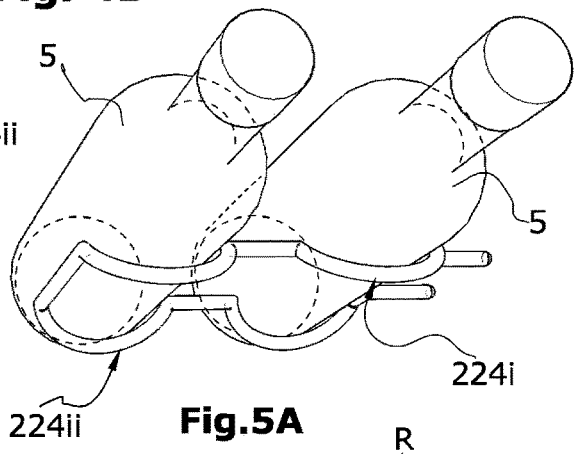
FIG. 5A is a lower perspective view of the bottle holder supporting bottles according to the third embodiment of the invention.

FIGS. 4-5A show that the bottles (5) may be held in an orientation in which they are parallel and horizontal to the fascia panel (10). In each case, the bottle (5) is supported at two locations along the length of the main body (7) by a pair of spaced arcs (124).

Figure 4B:
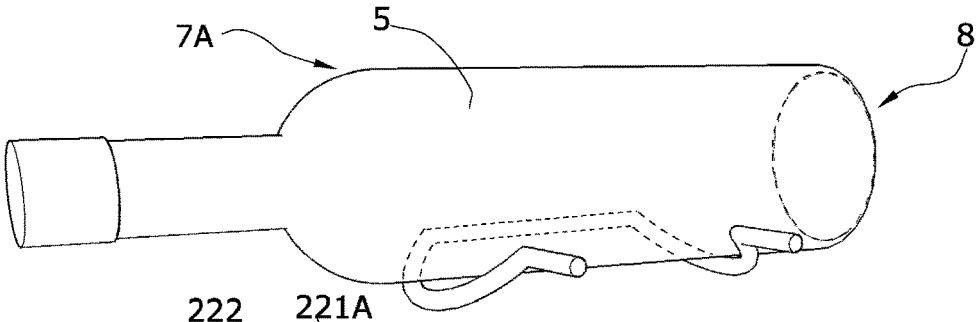
FIG. 4B is a right view of the bottle holder supporting a bottle according to the second embodiment of the invention.

In FIGS. 4-4B, there is shown a bottle holder (120) having a pair of spaced and parallel free ends (122), optionally joined at substantial right angles to a pair of spaced, substantially coaxial and discontinuous short sections (121A) that serve to locate attached arcs (124A,B) within the length of the main body (7) of the bottle (5). As shown in FIG. 4A, the short sections (121A) may be omitted and the arcs (124) joined directly to the free ends (122). The opposite end of the arcs (124) may be each joined to an end of a continuous elongate section (121B). The axial integrity by which the short sections (121A) may remain substantially coaxially aligned is achieved by locating the free ends (122) in the holes (11). The rigidity of the fascia panel (10) provides the requisite compression and tensile strength in the axial direction for the short sections (121A) to ensure that the spacing between these coaxial short sections (121A) remains constant, despite a load applied to the short sections (121A) by placing a bottle in the cradle provided by spaced arcs (124).

The 2 arcs (124A,B) are spaced to support the bottle (5) within the length of the main body (7). On the remote side of the arcs (124A,B) is an elongate section (121B) extending between the arcs (124A,B).

FIGS. 5-5A show a bottle holder including longitudinally aligned pairs of arcs (224), a proximal pair (224*i*) close to the free ends (222) and laterally spaced with respect to a remote pair (224*ii*). Each pair of arcs (224*i,ii*) is configured to support one bottle (5) in an orientation aligned substantially parallel to the front surface (10A) and substantially horizontal. The bottles (5) can be displayed clearly without obstruction as the cradles (124) are located under the bottles (5) and the wire of the bottle holders (120*i,ii*) is thin and unobtrusive. The embodiment shown in FIGS. 5 and 5A include short sections 221A and an elongate section (221B) similar to the embodiment shown in FIG. 4 to enable the longitudinal separation of the arc pairs (224*i*) and the arc pairs (224*ii*) to be optimised to support the main body (7).

Figure 6:
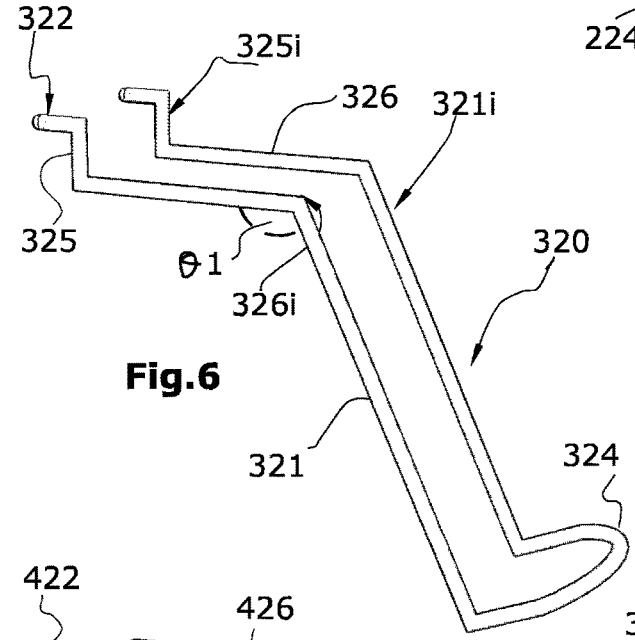
FIG. 6 is a perspective view of a bottle holder according to a fourth embodiment of the invention.
Figure 7:
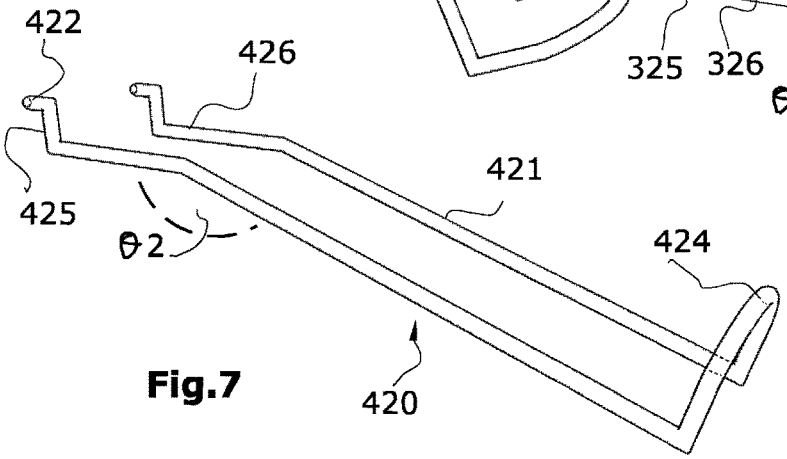
FIG. 7 is a perspective view of a bottle holder according to a fifth embodiment of the invention.

In another set of embodiments shown in FIGS. 6-7, the elongate section comprises initial sections (325) that may extend in parallel relationship to the longitudinal axes (344) of the free ends (322)

The bottles (5) may be aligned in a true horizontal position to provide a more pleasing visual display. However, the bottles holder may be adapted to display the bottle in an inclined or vertical drop position. Each free end may extend along a longitudinal axis that is inclined relative to the longitudinal axis of the elongate section with which it is continuous. There may be a bend joining the free end and the elongate section with which it is continuous having an angle theta that is in the range 0-90°, preferably about 0°, 20° or 70°.

Interposed between the free end (322) and its associated elongate section (321), there may be a Z-section including an initial short section (325) including a bend joining the free end (322) that is about 70-110°, and preferably about 90. The interposed Z-section includes the initial section (325) that depends downwardly from the free end (322) that is adapted to be received in a bore (11) in the fascia panel (10) that is aligned substantially normal to the general plane of the fascia panel (10). The Z-section may further include a substantially horizontal middle section (326) that space the initial section (325) and the free end (322) from an inclined elongate section (321) that is adapted, together with an arc joining section (324), to support the main body (7). The middle section (326) is configured to provide spacing to accommodate the neck (6) of a bottle (5) inclined in a generally upwardly orientation with the neck (6) inclined in the direction (R) toward the fascia panel (10). The elongate section (321) may extend from an elbow at the middle section (326) at one of a variety of desired inclinations, such as, for example, at a steep angle $theta_1$ (in FIGS. 6,6A) or $theta_2$ (in FIG. 7).

The bottles are held by the bottle holder (320,420) in an orientation that is perpendicular to the fascia panel (10) and angled with the bottleneck (6) inclined inwards toward the fascia panel (10). Bottle labels on the bottles (5) can be presented so that they are clearly visible for easy identification.

Figure 6A:
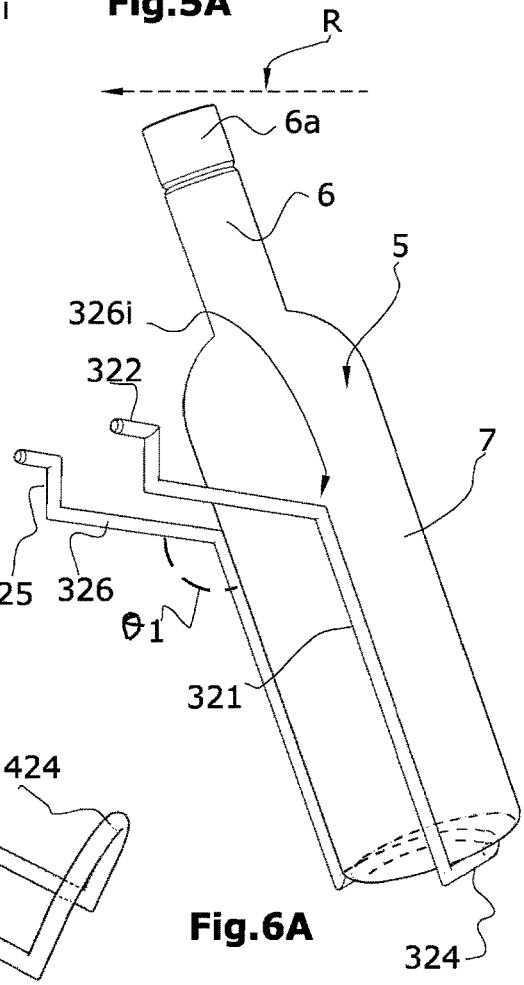
FIG. 6A is a perspective view of the bottle holder supporting a bottle according to the fourth embodiment of the invention.

The bottle angle $theta_{1,2}$ may extend from horizontal ($theta_{1,2}$=0°) to approx. 65°. In FIG. 6A, the bottle weight allows the bottle (5) to rest in a cradle (324) between the spaced and parallel elongate sections (321) that extend from the middle section (326) at the angle $theta_1$=65°. The arc (324) may be similar in radius to the previously described arcs (24,124,224), and the spacing between the elongate sections or side arms (321) are advantageously between 50% and 95% of the diameter of a standard wine bottle (750 mm). The arc 324 extends outwardly from the lower ends of the elongate sections (321) at about 90°, the side arms (321) cradling the main body (7) between the side rails (321) and supporting the base (8) of the bottle (5) against gravitational pull of the bottle (5) downwardly.

The length of the short middle sections or arms (326) varies to suit the angle $theta_{1,2}$ of the bottle (5) held in the cradle defined by the side elongate arms (321) and the arc (324), whereby the bottle cap (6*a*) or cork is clear of the fascia panel face (10A).

The bottle holders (20,120,220,320,420) as described FIGS. 3-7 are manufactured from small diameter steel or aluminium rod or wire. As the horizontal holes (11) in the fascia panel (10) are of equal or smaller diameter compared to the diameter of the free ends (22,122,222,322,422), a tool to provide the impact to insert the free ends (22,122,222, 322,422) into the holes is required and is provided in the form of the block.

Substantial distortion or damage to the bottle support bracket (20,120,220,320,420) may occur through the insertion process, without external support to the vertical and horizontal sections (x21,x22,x24,x25,x26, where x=0, 1, 2, 3 or 4) of the bottle holder (x20, where x=0, 1, 2, 3 or 4). To provide support for the bottle holder components for installation in to a fascia panel (10), a bracket insertion block (50) is provided that has specifically recessed grooves (52) to accommodate and structurally support the components (x21, x22, x24, x25, x26).

Referring to FIGS. 8-14A the block (50) is specifically designed to hold each bottle holder (x20). Each bracket insertion block (x50) is recessed with grooves to accommodate and complement to represent each type of bottle holder (x20).

Each bracket insertion block (x50) holds the various vertical, horizontal and inclined sections and arc components (x21,x22,x24,x25,x26) of the bottle holder (x20) in recessed grooves (52) that may be in the form of impression, laser cut, computer numerical control (CNC) milled, cast or moulded cavities.

The tapered ends (23A,B) of the free ends (x22) are positioned in line with the receiving holes (11) in the fascia panel (10) for quick and accurate insertion without causing damage to the fascia panel front surface (10A) surrounding the holes (11).

Particularly with reference to FIGS. 63-67, but with general reference to each of the bottle holders x20 and blocks x50, the block x50 is adapted to support the bottle holders x20 as they are inserted into the holes in the facia panel x10. The bottle holders x20 are press fit into the facia panel x10 while the block x50 keeps spigots x22 of the bottle holders x20 coaxial with the holes in the facia panel x10. Advantageously, this protects the holes from damage due to misalignment of the spigots x22 with the holes as the bottle holders x20 are inserted into the holes in the facia panel x10. The block x50 is supplemented with additional hardened drilling bushes 651A which are used as templates to accurately space the holes x11 in the facia panel x10 from each other. The drilling bushes include internal dimensions to closely fit a drill bit 670 of the correct size for the holes 11 in the facia panel x10. Hardened drilling bushes 651A are located in bush holes 653A that are offset from a front face x13 of the facia panel x10.

The offset creates a gap 614 between the hardened drilling bushes 651A and the front face of the facia panel x10 when drilling the holes x11 in the facia panel with the drill bit. Transverse recesses (extending perpendicular to the plane of the block or template) x52, x54, x57, x59 are used to position the template block x50 on the positioned holders x20 in order to accurately drill the next positioned bottle holder x20 holes x11. This gap 614 provides space to receive sawdust from drilling the holes x11. The hardened drilling bush 651A is also adapted to maintain the drill bit 670 at a 90 degree angle to the front face x13 of the facia panel during drilling. The block x50 further includes an alignment recess 654A which is adapted to line up with an edge of the facia panel x10 for positioning of the block x50 during drilling of the holes x11.

Figure 8:
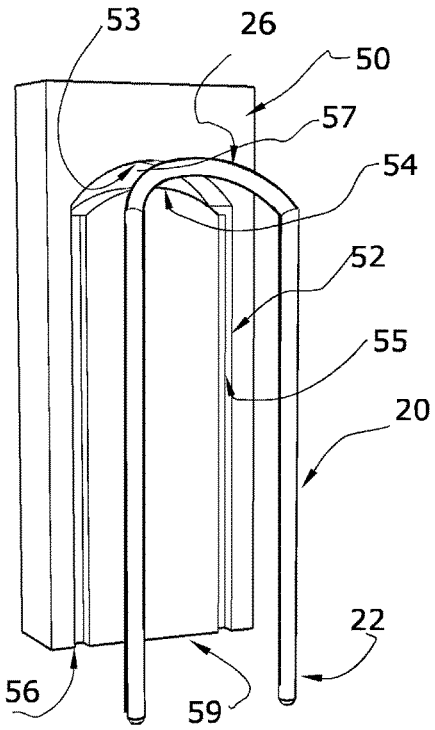
FIG. 8 is a perspective view of one of the bottle holders with a block according the first embodiment of the invention.
Figure 9:
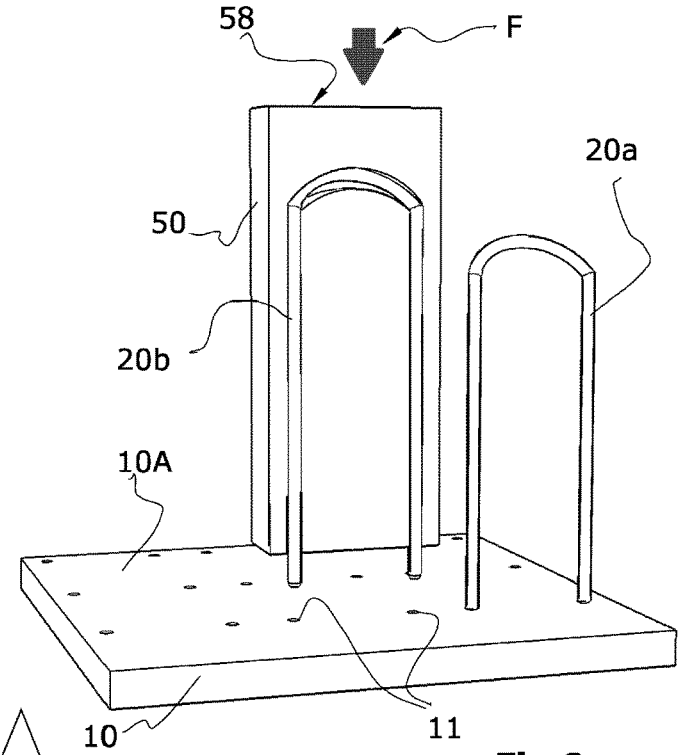
FIG. 9 is a perspective view of two of the bottle holders with a block being installed into the facia according to the first embodiment of the invention.
Figure 10:
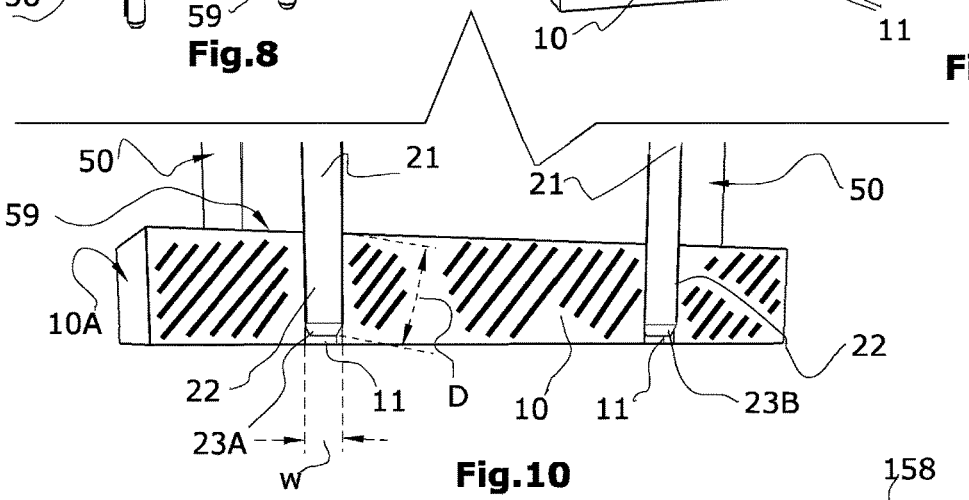
FIG. 10 is a perspective view of one of the bottle holders with the block installed into the facia according to the first embodiment of the invention.

Referring specifically to the embodiment shown in FIGS. 8-10, the recess (52) is defined by load wall surface (53), passive wall surface (54) and parallel side wall surfaces (55) that support the wire or rod forming the bottle holder material in the block (50). The load wall surface (53) bears on an outermost surface (26) of the arc (24), but the passive and parallel side wall surfaces (54,55) control the positioning of the bottle holder sections (21,24) and support them against transverse forces lateral to the longitudinal axis of the sections (21,22,24) at any linear or curved section in the length thereof, that might tend to bend the sections (21,22, 24) out of shape.

The bottle holder (20) material may be vulnerable against lateral forces caused when compressive forces are applied along the longitudinal axes (44) without the lateral support provided by the block (50). Accordingly, providing a recess (52) that is a close fit for the holder sections (21,24) is useful to ensure that the bottle holder is stably supported whilst the free ends (22) are urged to enter the holes (11).

The bottle holder (20) cannot be impacted or force applied through the arc (24) because too high a bending moment will be applied at the join between the arc (24) and the elongate (21) or other sections joining the arc (24). The load-bearing surface (53) allows force to be applied in the direction F or R to focus the force along the longitudinal axes (44). The generally laterally extending recesses providing surfaces (53,54) within each bracket insertion block (50), notably the upper face (53) of the curved lateral section of the recess (52) that is most remote from the tapered arm ends (23A,B), will be in contact with the upper face (26) of the arc (24) of the bottle holder (20).

The width of the lateral sections (53,54) of the recess (52) in the block (50) will be greater than the diameter of the sections (21,22,24) of rod or wire of the bottle holder (20) so that there is a space or gap (57) below the lateral sections (53,54) when the bottle holder (20) is encased or received in the recess (52) and is in position in the block (50). This may allow for easy withdrawal of the block (50) from the bottle holder (20) after the insertion of the free ends (22) in the holes (11) is complete.

The free ends (22) extend beyond the open ends (56) of the recess (52) and are configured to be gently driven into the registered holes (11). The width and length of the free ends (22) is dimensioned such that, on correct registration of the free ends (22) to the selected open holes (11), resistance provided by the holes (11) to entry of the free ends (22) is insufficient to provide enough compressive force along axes (44) for the linear free end sections (22) to buckle or bend transverse to the axes. Advantageously, the length:diameter ratio of the free end section (22) extending from the block (50) may be between 5:1 and 2:1, and preferably about 3:1, with the free ends (22) preferably being formed with a wire section having a diameter of about 3-6 mm, and preferably about 5-6 mm.

When the bottle holder (20) is positioned into the bracket insertion block recess (52) and the outer surface (26) is in contact with the lateral recess surface (53) most remote to the tapered arm ends (23A,B), the length of the free ends (22) extending beyond the innermost extent of the block (50) (closest to the fascia panel (10)) may not exceed the hole (11) depth in the fascia panel (10), when an innermost surface (59) of the block (50) of the bracket insertion block is in firm contact with or immediately adjacent to the outer surface (10A) of the fascia panel (10) (see, in particular, FIG. 10).

An outermost surface (58) of the block (50) may be used to impact the block (50) with a mallet, hammer or similar, to apply the force F to insert the free ends (22), leading with the tapered ends (23A,B) into the holes (11).

Variations (x50) of the block (50) are shown in FIGS. 11 to 14A that correspond to the variations (x20) of the bottle holder (20) shown in FIGS. 4-7.

Figure 11:
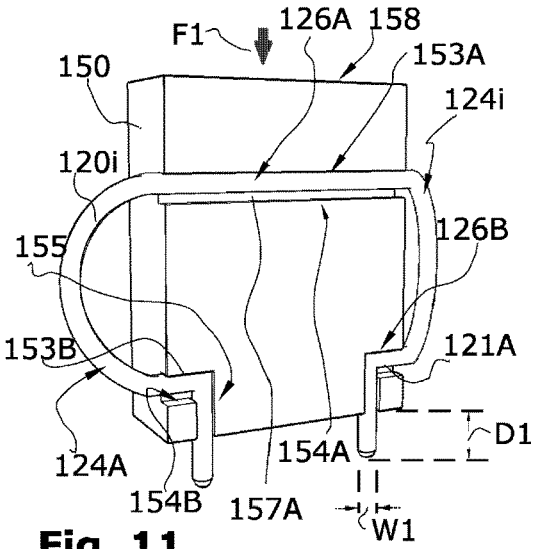
FIG. 11 is a perspective view of the bottle holder with a block according to the second embodiment of the invention.
Figure 11A:
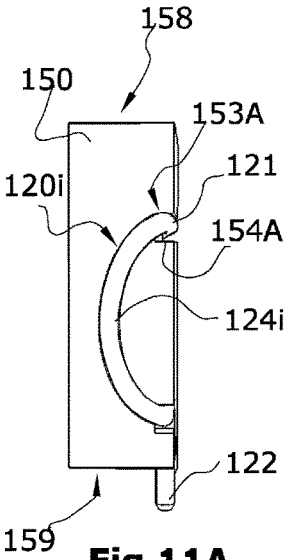
FIG. 11A is a front view of the bottle holder with the block according to the second embodiment of the invention.

As shown in FIGS. 11 and 11A, bottle holder (120*i*) can be supported by a block (150) having multiple discrete recesses (153A-B,154A-B), including an transverse elongate linear recess (153A,154A) to supportively accommodate the elongate section (126A) and a pair of laterally spaced, L-shaped recesses (153B,154B) that supportively accommodate the short sections (121A) and a first part of the free ends (122), leaving the outer extents of the free ends (122) to extend beyond the innermost end (159) for insertion into the holes (11).

Figure 12:
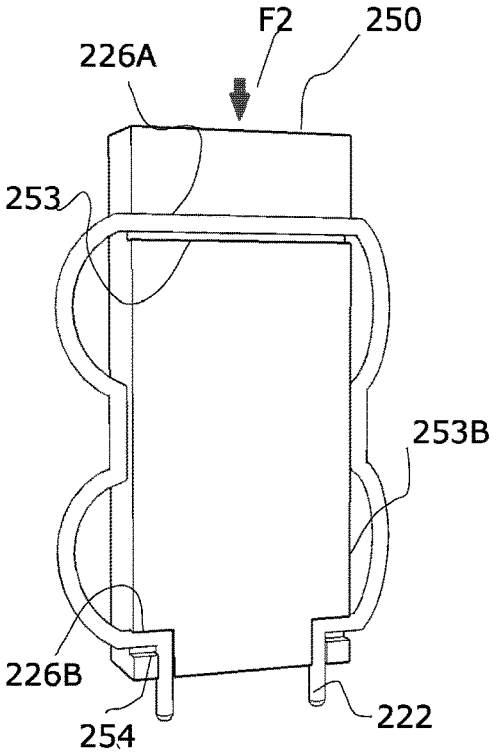
FIG. 12 is a perspective view of the bottle holder with a block according to the third embodiment of the invention.
Figure 13:
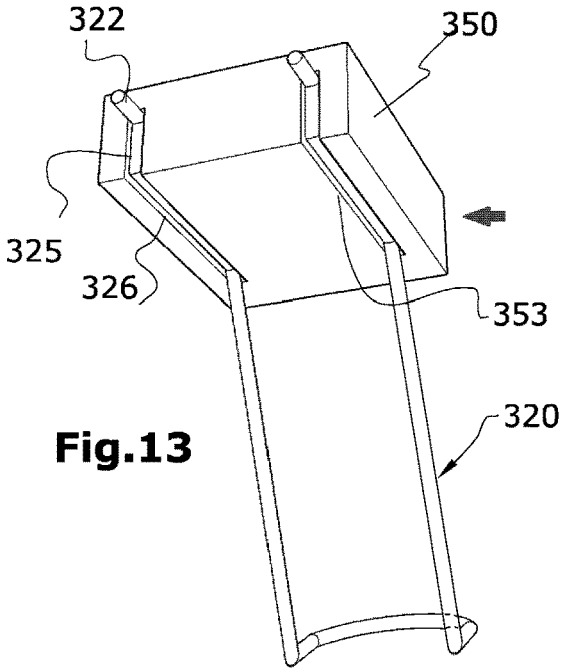
FIG. 13 is a perspective view of the bottle holder with a block according to the fourth embodiment of the invention.
Figure 13A:
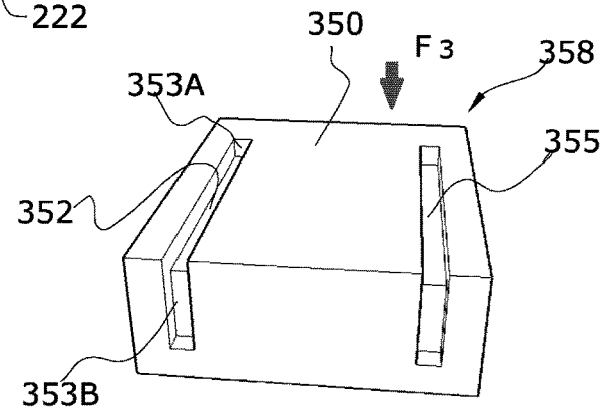
FIG. 13A is a perspective view of the block according to the fourth embodiment of the invention.

An outermost surface (158) of the block (150) may be used to impact the block (150) with a mallet, hammer or similar, to apply the force to insert the free ends (122) into the holes (11). In FIG. 12, a block 250 is shown to accommodate lateral sections 226A,B in respective laterally extending recesses (253,254), but otherwise is similar in its operation to the block 150. The holder version (320) is accommodated in a block 350 for insertion of its free ends (322) in the holes (11). The block (350) includes a pair of spaced, parallel, linear, longitudinally aligned recesses (352) to receive the elongate sections (321). The holder (320) has load bearing surfaces (321*i*) and (325*i*) adjacent the elbow (326*i*) at the innermost end of the elongate section (321) and the outer-facing surface (325*i*) of the initial section (325). Respectively, the loadbearing surfaces (325*i*) and (326*i*) abut and come to bear against inward facing surfaces (353B) and (353A) on application of force $F_3$ on the outermost wall (358) of the block (350). The load bearing surface (353B) is located in slot-shaped portion of the recesses (352) that is continuous with an elongate recess section (355) that terminates intermediate the length of the block (350) at load bearing surface (353A).

Figure 14:
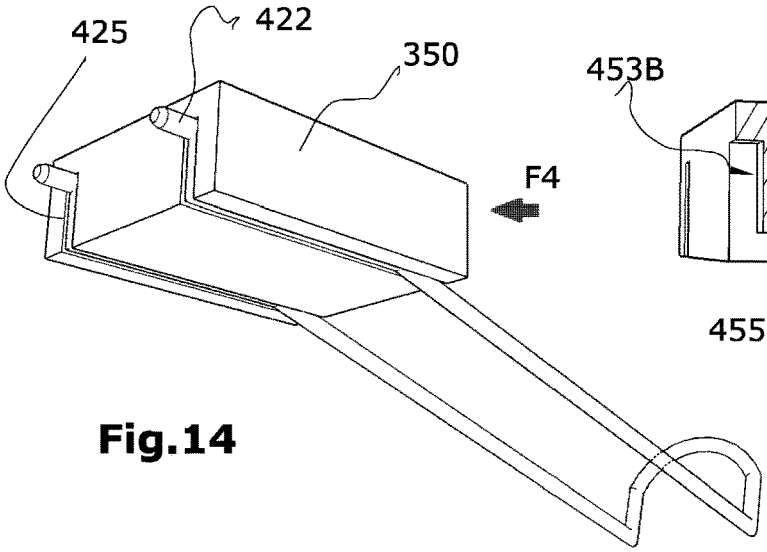
FIG. 14 is a perspective view of the bottle holder with a block according to the fifth embodiment of the invention.
Figure 14A:
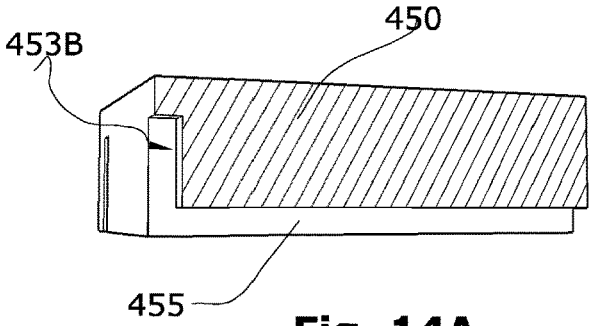
FIG. 14A is a perspective view of the block according to the fifth embodiment of the invention.
Figure 15:
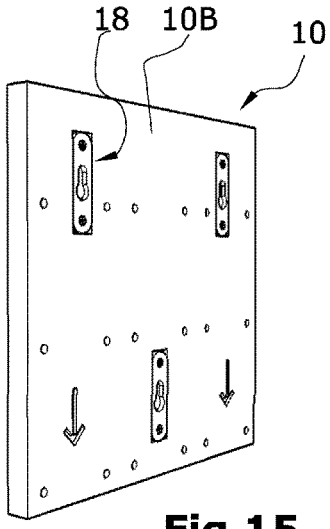
FIG. 15 is a perspective view of the facia according to any one of the first to fifth embodiments of the invention.
Figure 16:
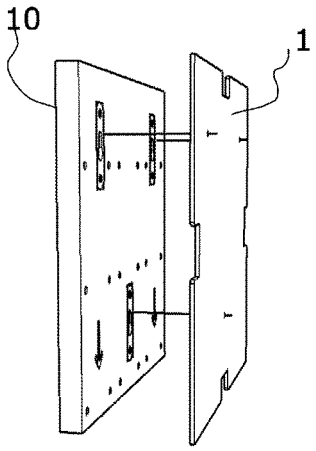
FIG. 16 is a perspective view of the facia and a female template according to any one of the first to fifth embodiments of the invention.
Figure 17:
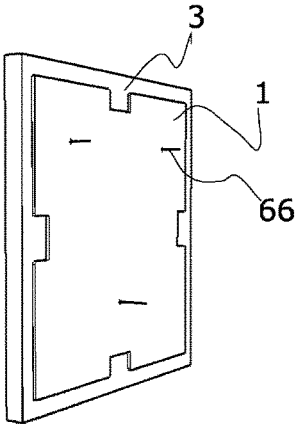
FIG. 17 is a perspective view of the female template and a wall according to any one of the first to fifth embodiments of the invention.

A block 450 is shown in FIGS. 14-14A that is similar to the block 350, but does not have loadbearing walls equivalent to surfaces (353A), but the elongate recess sections (455) extend the full length of the block (450). In each of the block versions (150,250,350,450), the initial section (322, 422) or free end (122,222) is received in a recess that has a load bearing surface (153B,253B,353B,453B) that faces in the same direction as the direction of application of force ($F_{1,2,3,4}$).

Another aspect of the invention is to provide simple and accurate systems for installation of the fascia panel (10) as in a single unit or in multiple arrangements to a substrate such as dry flat wall surfaces. The systems advantageously would not, in the view of the inventor, require skilled labour to install.

Dry flat wall surfaces may be constructed from the following:

1. Hollow walls with the internal components being metal or timber wall studs, with the wall faces (3) being of plaster or plasterboard construction; 2. Cavity or solid construction walls; or 3. Concrete-, brick- or masonry-constructed walls.

Figure 18:
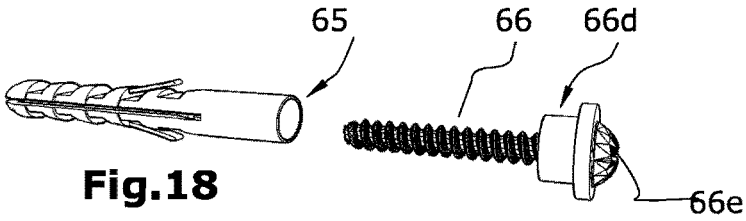
FIG. 18 is a perspective view of a masonry plug, threaded screw and spacer according to any one of the first to fifth embodiments of the invention.
Figure 19:
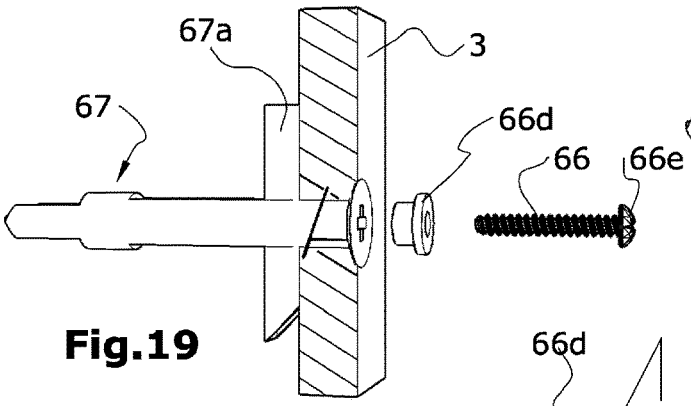
FIG. 19 is a perspective cross sectional view of a plaster plug in the wall with an exploded view of the threaded screw for insertion into the plaster plug and the spacer according to any one of the first to fifth embodiments of the invention.
Figure 19A:
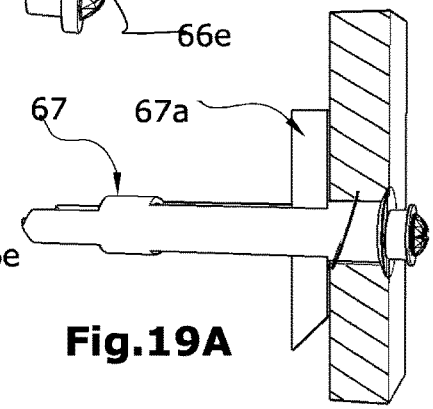
FIG. 19A is an assembled perspective cross sectional view of the plaster plug in the wall with the threaded screw and the spacer according to any one of the first to fifth embodiments of the invention.

The wall anchors (plugs) (65, 67) shown in FIGS. 18 and 19 required to be inserted into such walls for the purpose of mounting the fascia panels (10) are of current commercial availability. The fascia panels (10), regardless of shape and size, have commercially available keyhole connector plates (18) shown in FIGS. 15, 16, 21C-D recessed and fixed into the 2nd face (10B) of the fascia panels (10). The invention allows for each fascia panel (10) to be removed or replaced at any time, without the need for additional work or tools being required.

The inventive arrangement may include multiple panels (10) incorporated together.

In a first method for installation of the fascia panel (10) and bottle holder (20), the fascia panel (10) connects directly to a surface of a hollow dry flat wall or a masonry wall using wall anchors (65, 67) shown in FIG. 18 or 19 and threaded screws (66) spaced with a spacer (66*d*). The wall anchors (65, 67) are adapted to receive the threaded screws (66). One female template (1) can be used to mount one fascia panel (10). One female template (1), one male template (2) and multiple fascia panels (10) can be used to make a bottle holder arrangement. The male and female templates (1, 2) may be constructed from rigid material such as 2-3 mm MDF, plywood, plastic, stable cardboard or similar materials. Paper or similarly flexible materials may not be sufficiently stable to provide layout accuracy.

Figure 24:
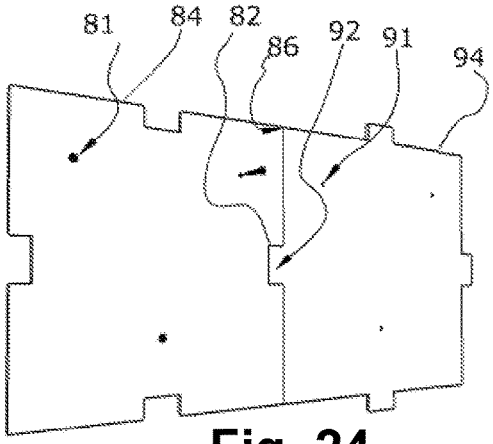
FIG. 24 is a perspective view of the templates (including a male template and a female template) according to any one of the first to fifth embodiments of the invention.

As shown in FIG. 24, the main body of the template 1,2 may be a mirror image of the selected fascia panel (10). or can be proportionally larger if a space is required between the panels (10) when a multiple fascia panel (10) arrangement is required.

Figure 25:
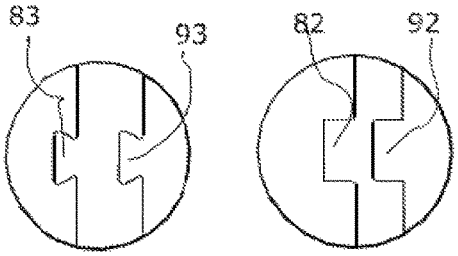
FIG. 25 is a front view of optional recesses of the female template and male extensions of the male template according to any one of the first to fifth embodiments of the invention.

The female template (1) has female recesses (82) in each side edge (84). The recesses (82) are shaped to fit with the corresponding male extensions (92) on side edges (94) of the male template (2). As shown in FIG. 24, the square or rectangular-shaped male extensions (92) fit snugly inside the correspondingly shaped recesses (82) of the template (1), so that the positioning of the template (1) is effective to accurately position the template (2). FIG. 25 shows that other male/female shapes (83,93) may be effectively used such as trapezoids.

The accuracy of the fit of the extensions and recesses (82,92) may be such that the corresponding template (2) edges (94) are aligned edge (84) to edge (94) and top and bottom corners (86,96) of the two templates (1,2) are also aligned as seen in FIG. 24. Pilot holes (91) that align the wall anchors, the wall anchors including the masonry plugs 65 and/or plaster plugs 67, spacers 66*d* and threaded screws (66) with the finished position of the fascia panels (10) via the keyhole connector plates (18) are drilled through both templates (1,2) as shown in FIGS. 16, 17, 20, 22 and 24. The masonry plug 65 is adapted for insertion into masonry and the plaster plug 67 is adapted for insertion into plaster and/or plasterboard. The spacer 66*d* is located around the threaded screw (66) and in between a threaded screw head 66*e* and the masonry plug 65 or the plaster plug 67.

The diameter of a hole (81, 91) is identical or slightly less than the diameter of the internal hollow section of the masonry plug 65 and/or plaster plug 67. For example, a 4.2 mm hole (81, 91) corresponds to an 8G screw, wherein the hole (81, 91) matches the screws shaft diameter resulting in light registration of the screw and the hole (81, 91). The first template (1) is aligned and levelled on a selected flat wall surface (3) and guide holes are drilled through the first template pilot holes (81) into the flat wall face (3). The templates (1, 2) may only be used for drilling the pilot holes (81, 91) into the flat wall face (3) and the templates (1, 2) may then be removed and reused on another installation.

The selected wall anchors and plugs (65, 67) (masonry plug and plaster plug) are inserted into the holes (81, 91) in the substrate wall (3).

To mount a single fascia panel (10), the threaded screw (66) and spacer (66*d*) is inserted into the masonry anchor (65) (masonry plug) or plaster anchor (67) (plaster plug), which are located in the wall (3). The threaded screw (66) and spacer (66*d*) inserted into the plaster anchor (67) is shown in FIG. 20.

Figure 20:
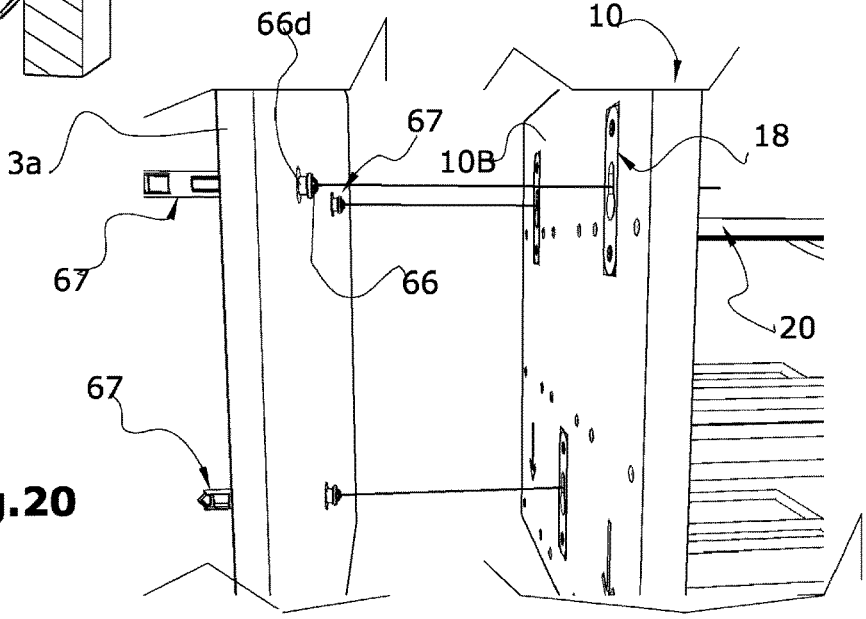
FIG. 20 is an exploded perspective view of the facia mountable to the spacers attached to the plaster plugs in the wall according to any one of the first to fifth embodiments of the invention.
Figure 21A:
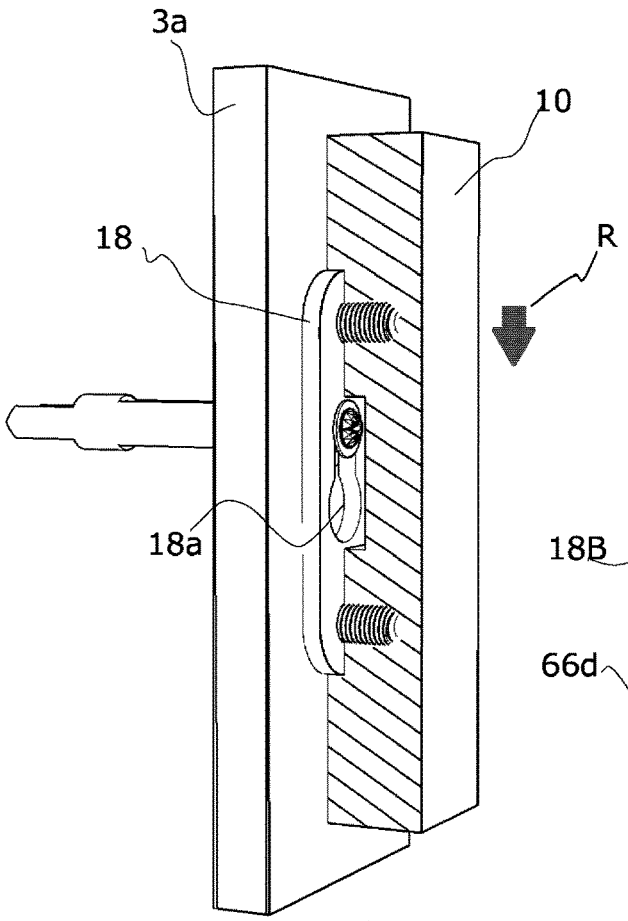
FIG. 21A is a perspective cross sectional view of the facia mounted to the wall according to any one of the first to fifth embodiments of the invention.
Figure 21B:
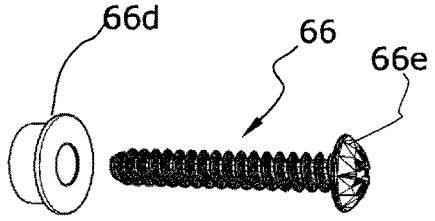
FIG. 21B is a perspective view of the threaded crew and spacer according to any one of the first to fifth embodiments of the invention.
Figure 21C:
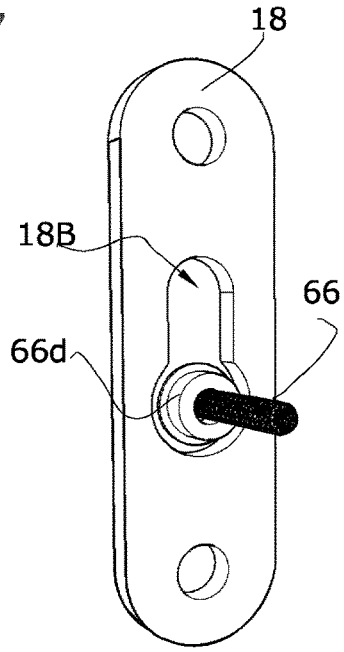
FIG. 21C is a perspective view of the threaded screw and spacer in a lower circular section of a keyhole connector plate according to any one the first to fifth embodiments of the invention.
Figure 21D:
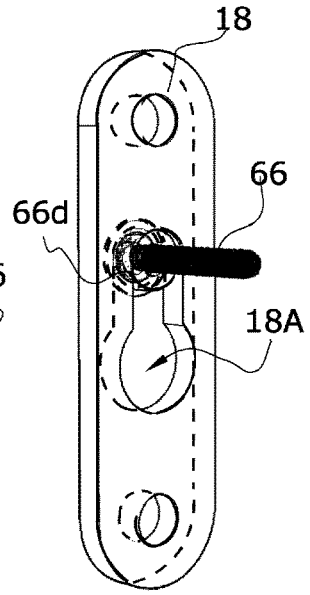
FIG. 21D is a perspective view of the threaded screw and spacer in an upper circular section of the keyhole connector plate according to any one of the first to fifth embodiments of the invention.
Figure 22:
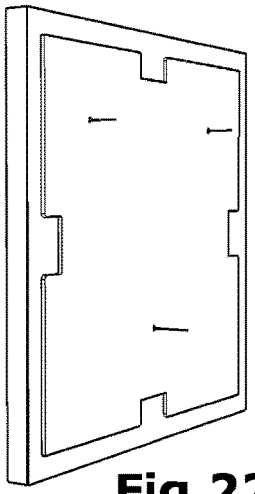
FIG. 22 is a perspective view of the female template on the wall according to any one of the first to fifth embodiments of the invention.

With reference to FIGS. 20-21A, following installation of the threaded screws (66), spacers (66*d*) and wall anchors (65, 67), the selected fascia panel's connector key holes (18) lower circular sections (18*a*) and the spacers (66*d*) are aligned and the spacers (66*d*) are then inserted into the lower circular sections (18*a*) and the fascia panel (10) is pulled in a downward motion such that the spacers (66*d*) slide into upper circular sections (18*b*) until the fascia panel (10) is fully engaged as shown in FIG. 21A.

Figure 23:
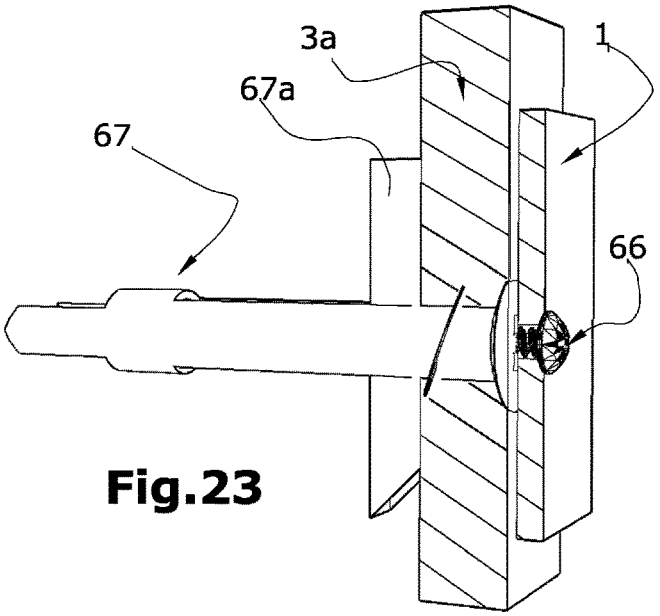
FIG. 23 is a perspective cross sectional view of the plaster plug and the toggle bolt with a template attached to the wall through the threaded screw according to any one of the first to fifth embodiments of the invention.
Figure 30:
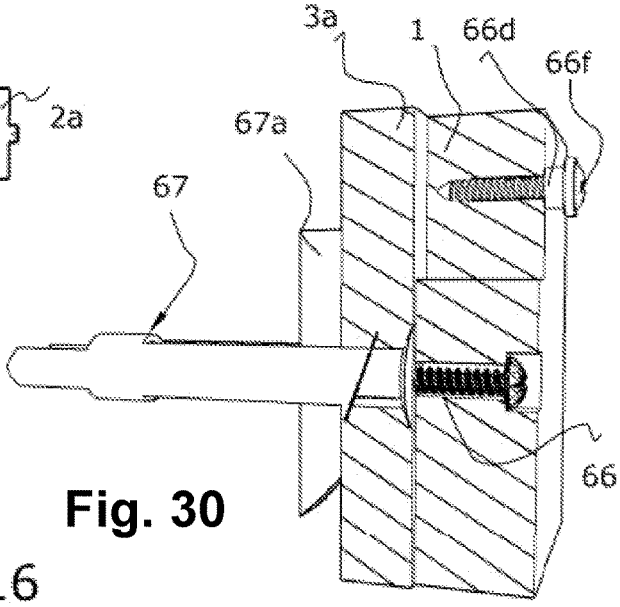
FIG. 30 is a perspective cross sectional view of a plaster plug, toggle bolt, threaded screw and the backing plate attached to a wall according to the sixth embodiment of the invention.

In FIG. 24, multiple templates (1,2) may be used to provide the backing for corresponding multiples of the fascia panels (10). To install a bottle holder or display arrangement with multiple fascia panels (10), the first template (1) is positioned and aligned over the inserted anchors/plugs (65, 67) (masonry anchor and plaster anchor). The threaded screw(s) (66) are inserted into the anchors/plugs (65, 67) as shown in FIG. 23. A toggle bolt 67*a* may also be used to anchor the multiple templates (1, 2) or backing plates (1) to plasterboard as seen in FIGS. 23 and 30.

The second template (2) is positioned and interlocked by the female recesses (82) in template (1) to the male projections (92) in the template (2) to provide a perfect alignment for the pilot holes in the template (2) to accurately position the next required fascia panel (10).

The process is repeated until the required arrangement is completed.

An example is shown in FIGS. 20-21A of a fascia panel (10) mounted directly to the wall (3*a*), using screw mounting assemblies (65, 67), in the form of the masonry anchor 65 or plaster anchor 67, inserted into the plaster wall board (3*a*). Preparatory to the screw mounting assemblies (65, 67) being mounted in the wall (3*a*), the template (1) is used as a guide to form three triangularly arranged and spaced holes which are adapted to receive the masonry anchor and plaster anchor (65, 67). The screws (66) heads are positioned to protrude from each screw mounting assembly (65, 67) whereby to be received in the respective keyhole connector plates (18) or router apertures.

Figure 31:
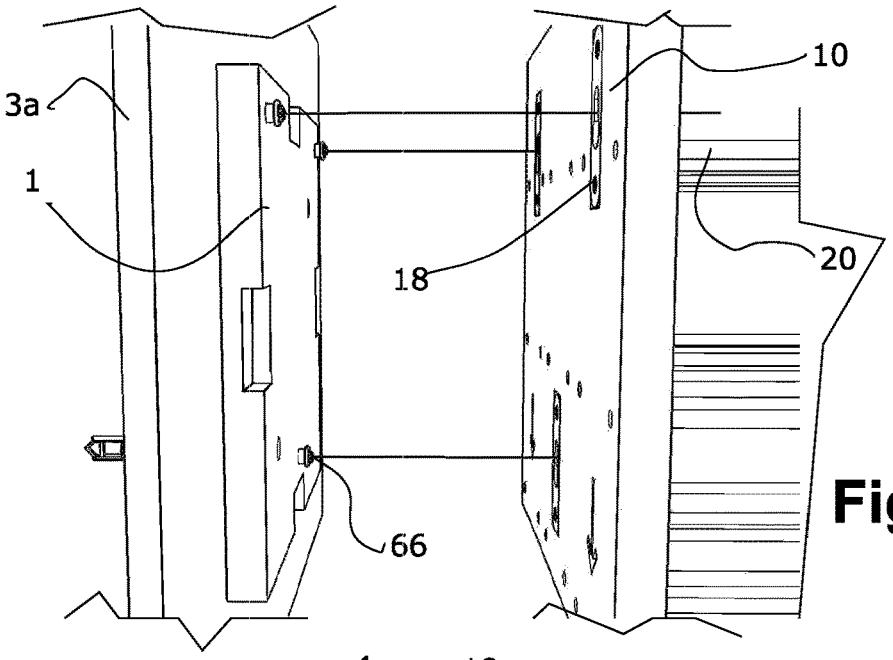
FIG. 31 is a perspective partially exploded view of a facia, bottle holders and the backing plate attached to the wall according to the sixth embodiment of the invention.
Figure 32:
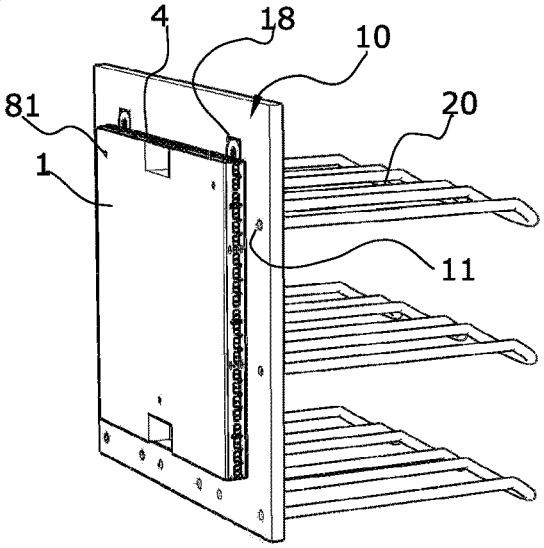
FIG. 32 is a perspective view of the facia, bottle holders and backing plate with a strip of LED's (light emitting diodes) on the backing plate according to the sixth embodiment of the invention.

A second method of installation involves the use of one or more backing plates (1) and/or backing plate connectors (2*a*) positioned between the flat wall face (3*a*) and the fascia panel (10). In FIG. 31, the backing plate (1) provides a similar supporting footprint to the fascia panel (10) when viewed from front on, but is smaller than the facia panel (10). The backing plate (1) is shorter in length and width than the fascia panel (10). With reference to FIG. 31, this may be used to provide a shadow affect behind the fascia panel (10) against the flat wall face (3*a*), which can be accentuated by lining the periphery of the backing plate (1) or the fascia panel (10) with decorative lights, such as a strip of LEDs (4). The backing plate (1) is of such a thickness (for example, 6-20 mm, and preferably 10-16 mm), that it can receive LED strip lighting (or similar) (4) to be attached to the exposed edge surfaces in order to achieve a back lighting affect behind the attached fascia panel(s) (10).

Figure 33:
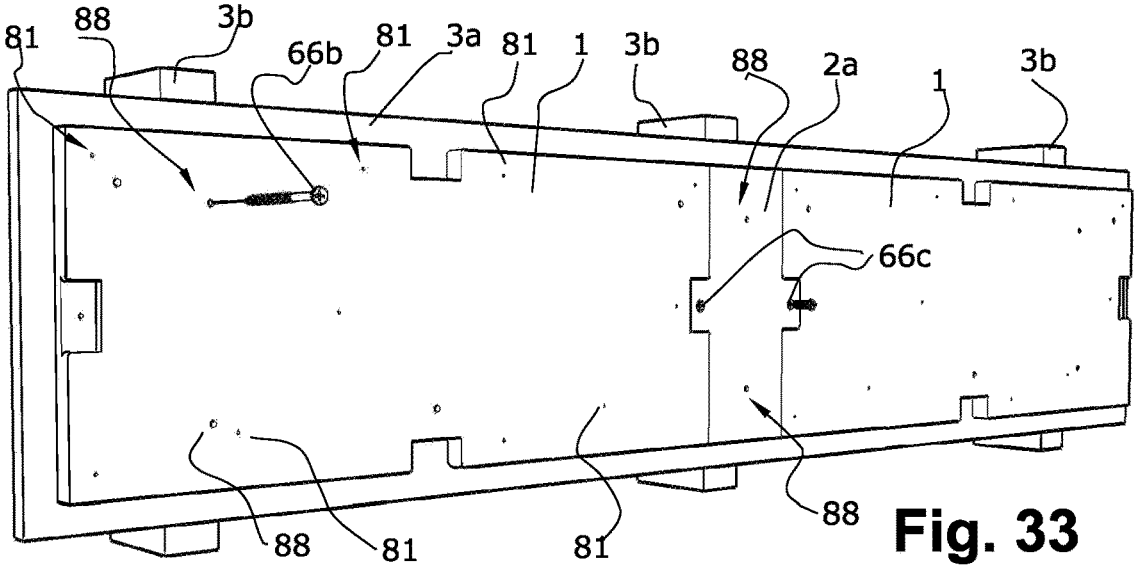
FIG. 33 is a perspective view of two backing plates connected by the backing plate connector and mounted to wall studs through the wall according to the sixth embodiment of the invention.
Figure 34:
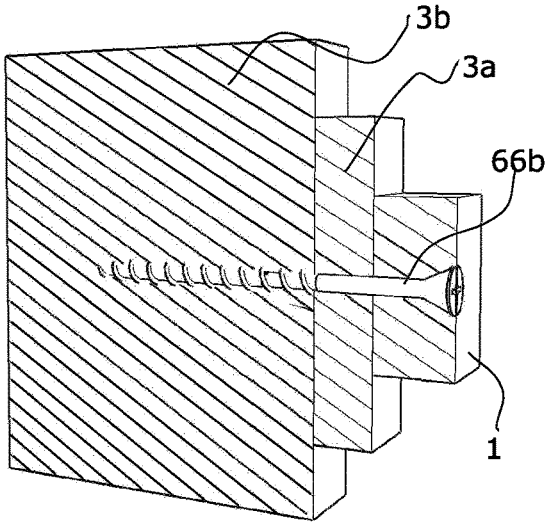
FIG. 34 is a perspective view of a threaded screw attaching the backing plate to the wall stud through the wall according to the sixth embodiment of the invention.
Figure 35:
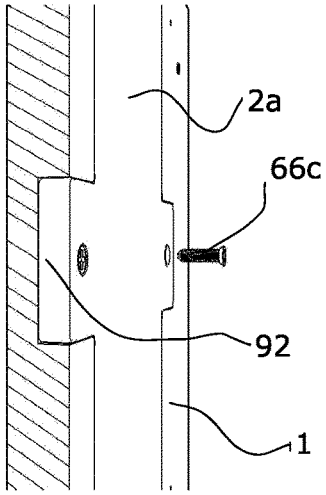
FIG. 35 is a perspective view of the backing plates attached to the backing plate connector with screws according to the sixth embodiment of the invention.
Figure 36:
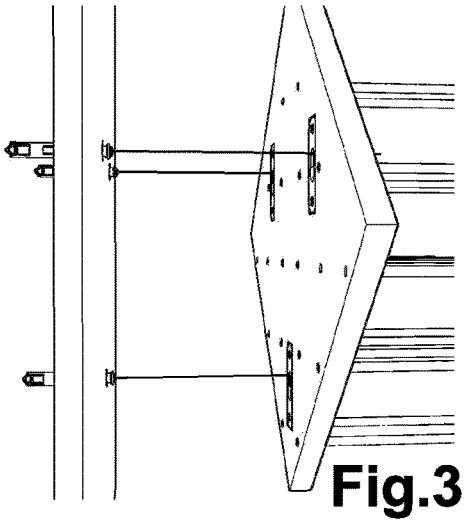
FIG. 36 is a perspective partially exploded view of a facia with bottle holders mountable to spacers attached to a wall according to a seventh embodiment of the invention.
Figure 37:
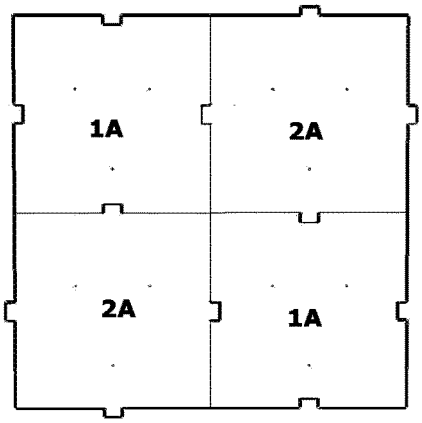
FIG. 37 is a front view of multiple templates connected together according to the seventh embodiment of the invention.
Figure 38:
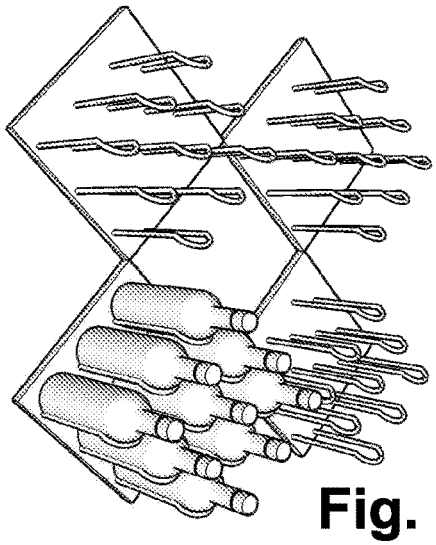
FIG. 38 is a perspective view of the facia with the bottle holders supporting bottles according to the seventh embodiment of the invention.
Figure 39:
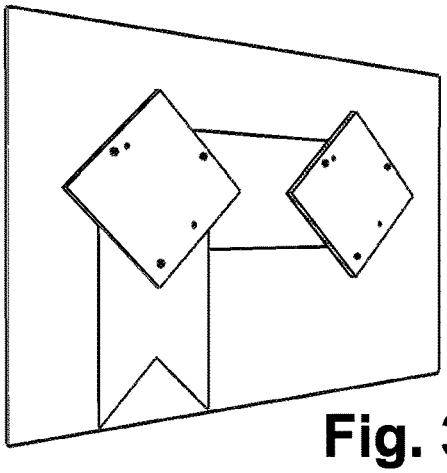
FIG. 39 is a front view of the backing plates with removable backing plate templates attached to a wall according to the eighth embodiment of the invention.
Figure 40:
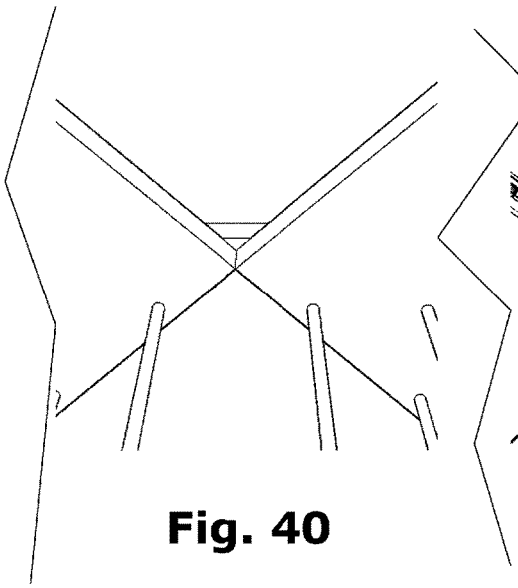
FIG. 40 is a perspective view of two fasciae mounted to a wall and spaced with a removable spacer and/or light emitting diode (LED) cover according to a ninth embodiment of the invention.
Figure 41:
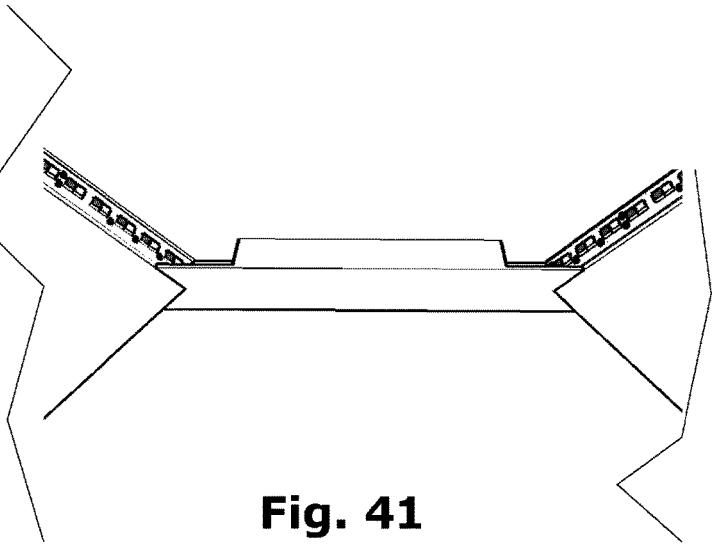
FIG. 41 is a perspective view of two backing plates attached to the wall and spaced with the removable spacer and/or LED cover according to the ninth embodiment of the invention.
Figure 42:
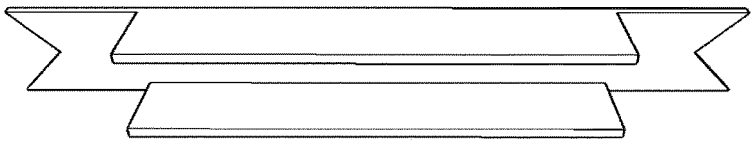
FIG. 42 is a back perspective view of the removable spacer and/or LED cover according to the ninth embodiment of the invention.
Figure 43:
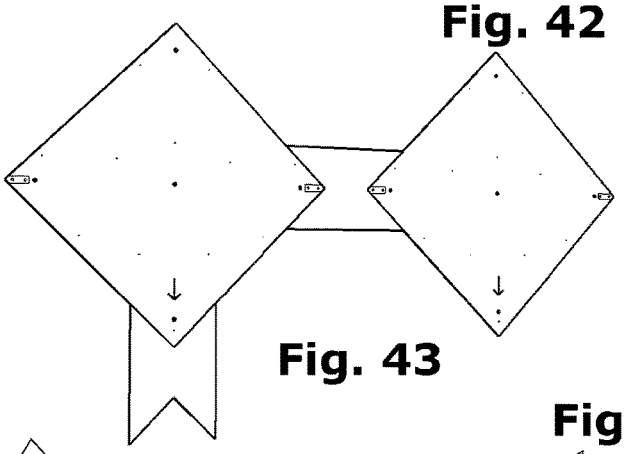
FIG. 43 is a front view of two of the backing plates spaced apart with removable spacers according to an eleventh embodiment of the invention.
Figure 45:
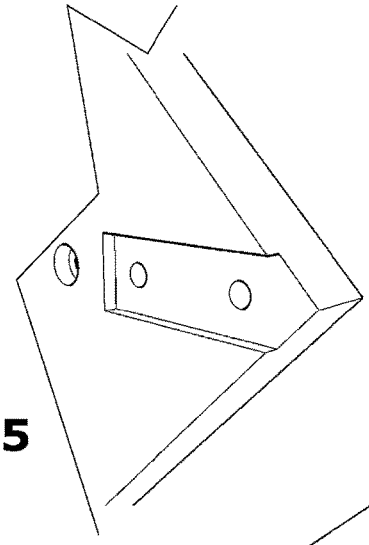
FIGS. 44-46 show a connector bar and/or LED cover receivable in counter-sunk slots formed in the corners of templates.
Figure 44:
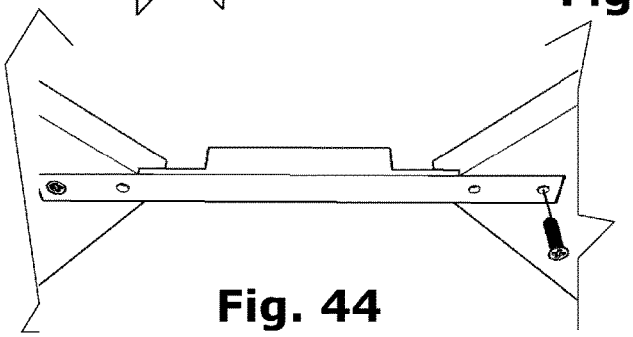
Figure 46:
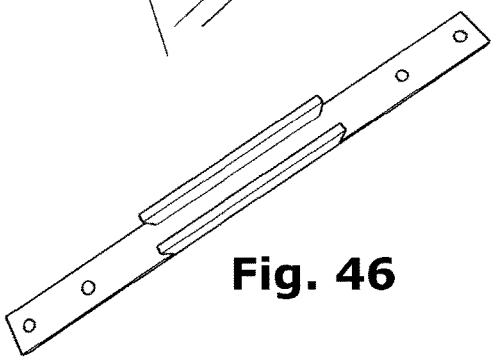
Figure 47:
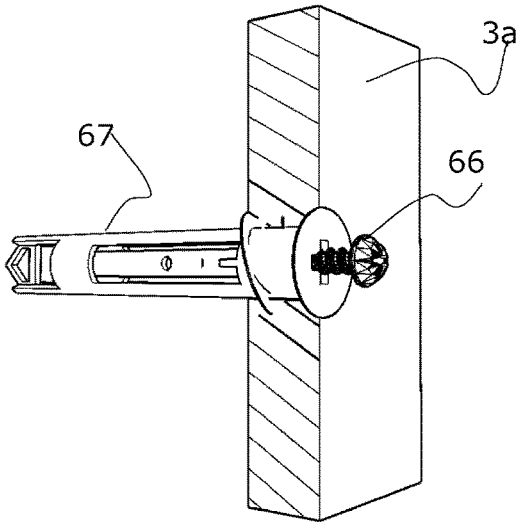
FIG. 47 is a perspective view of a plaster plug and threaded screw in a wall according to a twelfth embodiment of the invention.
Figure 48:
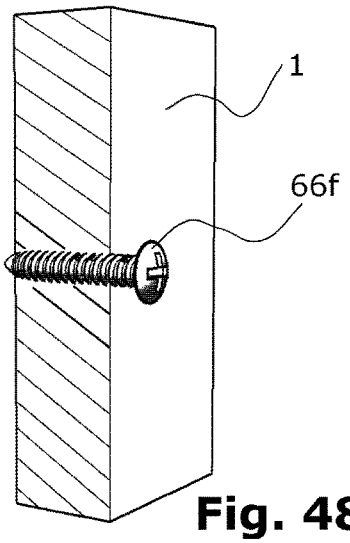
FIG. 48 is a perspective view of a threaded screw in a backing plate according to a thirteenth embodiment of the invention.
Figure 49:
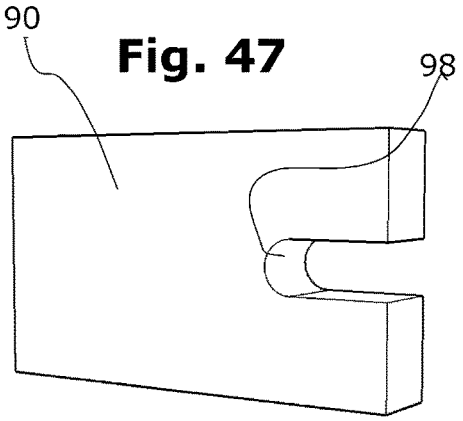
FIG. 49 is a perspective view of a keyhole removable spacer according to a twelfth or thirteenth embodiment of the invention.
Figure 50:
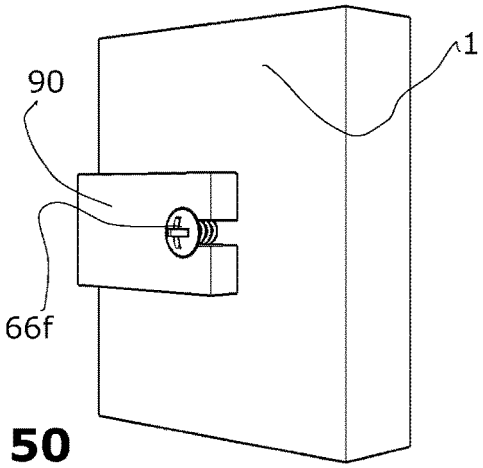
FIG. 50 is a perspective view of the keyhole connector plate connected to the threaded screw according to the thirteenth embodiment of the invention.

Another form of installation is shown in FIG. 33 using multiple backing plates (1,2) and backing plate connectors (2*a*) to mount the backing plates (1,2) to a plaster wall (3*a*) using the stud (3*b*) lines as the mounting points (88). The backing plate connectors (2*a*) are optionally removable after the backing plates (1, 2) have been installed. Therefore, the backing plate connectors (2*a*) are adapted to provide the correct spacing and alignment between the backing plates (1, 2). The backing plates (1) remain in place after first being used to provide pilot holes (81) in the plasterboard (3*a*) at locations not necessarily aligned with the studs (3*b*). The backing plates (1) are attached to the studs (3*b*) with wood or metal screws depending on if the studs (3*b*) are made of wood or metal respectively. Therefore, the templates (1) can also perform as permanent backing plates and vice versa.

The wall anchor/plug receiving holes drilled into the backing plate/s require a recess to allow the head (66*e*) of the threaded screw (66) not to be exposed above the backing plate surface as shown in FIG. 33 when secured into the wall bore or a wall anchor/plug.

Pilot holes (81) that align the finished position of the fascia panel (10) (as per the first form of installation) are positioned in the backing panel/s (1) to receive the facia panel/s (10). Screws (660 and spacers (66*d*) are adapted to be inserted into the pilot holes (81). The screws 66*f* are adapted not to extend through the whole backing plate (1). The screws 66*f* and spacers 66*d* are adapted to receive the facia panel/s (10). The screws (660 are of a short length whereby they do not contact the wall (3*a*) or the studs (3*b*). The screws (660 are shorter than the threaded screws (66).

Figure 29:
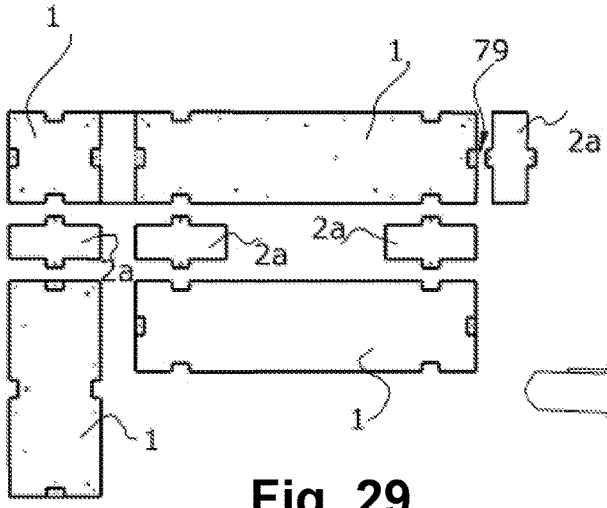
FIG. 29 is a front partially exploded view of multiple backing plates and backing plate connectors adapted to be attached together according to the sixth embodiment of the invention.

As shown in FIG. 33, backing plates (1) that support two or more fascia panels (10) are pre drilled to receive the fascia panels (10) in their correct position/s when the backing plate/s (1) are in the horizontal or vertical positions FIG. 29.

Each backing plate (1) has female recesses (82) on each side face as per the template (1) in the first form of installation.

When the backing plate (1) is in its horizontal position as shown in FIG. 29, the recesses (82) on the horizontal side faces are shown to be recessed to between 40-60% and preferably about 50 percent of their depth (74). In the remaining section of the recess (82) a hole (75) is drilled through the section that will be aligned to the hole (75*a*) drilled in the male external sections (92) of the backing plate connector (2*a*) when in position with the backing plate (1). Screws (66*c*) inserted through the holes (75, 75*a*) secure each of the backing plates (1) and backing plate connectors (2*a*) together. The screws (66*c*) are adapted to only be drilled to a certain depth. The screws (66*c*) only contact the backing plates (1) and backing plate connectors (2*a*) and do not contact the wall (3*a*) or studs (3*b*).

When multiple backing plates (1) are required to make the arrangement, the backing plate connector (2*a*) (which is of the same thickness of the backing plate (1)) spaces the backing plate (1) so that the fascia panels 10) will align as required when in both the horizontal and vertical positions, as illustrated in FIG. 29.

The male extensions (92) on the backing plate connector (2*a*) or a backing plate spacer inter connect with the recesses (82) of the backing plate (1). The male extensions (92) are recessed to between 40-60% and preferably about 50% of their thickness so as to align with the female recesses (82) in the backing plate/s (1).

Anchors/plugs (65, 67) are not suited to all hollow wall applications. This may be because the wall's surface structural integrity may not be maintained to standard or because a property is rented and the landlord may not allow the use of wall anchors/plugs (65, 67). It may also be because a client does not want to use wall anchors/plugs. Thus, as shown in FIG. 33, the form of installation described above includes a system where the fascia panels (10) can be successfully installed and displayed onto a wall stud 3*b* and supported by a hollow flat wall (3*a*) to overcome these restrictions. The backing plates (1) and backing plate connectors (79) are used.

Figure 26:
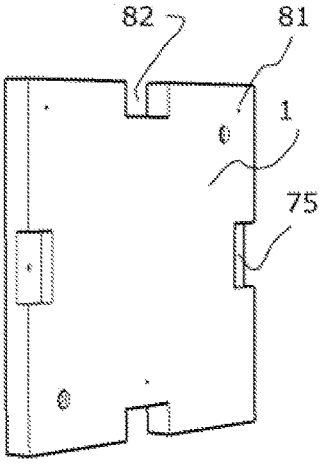
FIG. 26 is a perspective view of a backing plate according to a sixth embodiment of the invention.
Figure 27:
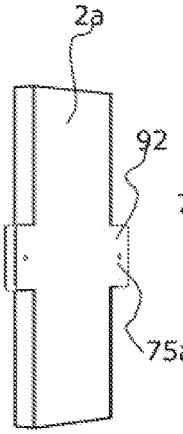
FIG. 27A is a perspective view of a backing plate connector according to the sixth embodiment of the invention.
Figure 28:
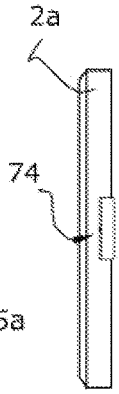
FIG. 28 is a side view of the backing plate connector according to the sixth embodiment of the invention.

The backing plates (1) shown in FIGS. 26, 27 and 28 and backing plate connectors (79) are joined as one by securing the backing plate connector (79) using a screw to join the registered holes (75,75*a*) to lock them together.

Regardless of the wall stud (3*b*) spacings, the backing plate (1) and backing plate connector (2*a*) configuration can be secured with standard wood or metal screws (66*b*) to the wall studs (3*b*), providing structural integrity that will only leave a foot print in the wall surface (3*a*) comparable to that of hanging a painting. Each backing plate (1) may be joined together with screws 66*c* extending through the male extensions (92) and recesses (82).

As the backing plates (1) and backing plate connectors (2*a*) are secured to the wall studs (3*b*), any structural integrity short comings of the wall surface materials (3*a*) may be overcome. The fascia panels (10) are connected to the backing plate (1)/backing plate connectors (2*a*) as previously described in the second mounting option.

FIGS. 47 to 51 show an optional method of attaching the facia, using a keyhole removable spacer (90), to the wall (3*a*) or to the backing plate (1). The method involves slotting a threaded screw attached to the backing plate (1) or wall (3*a*) into a slot 98 in the keyhole removable spacer (90). The keyhole removable spacer (90) is adapted to connect the multiple backing plates (1, 2) or the fascia (10) together to provide correct spacing and alignment.

Figure 51:
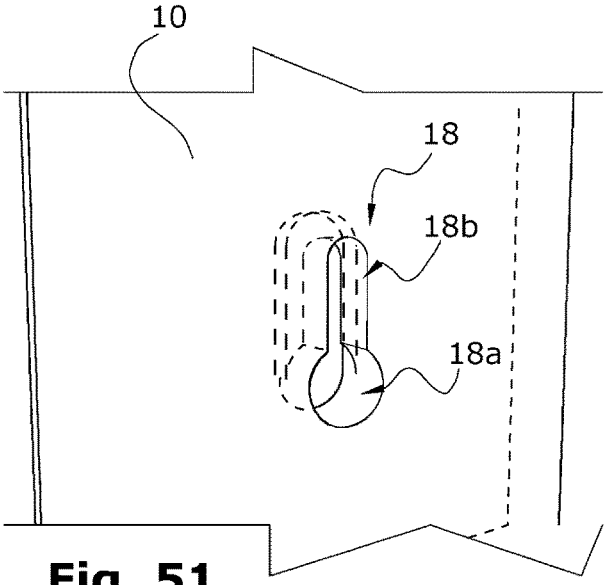
FIG. 51 is a back perspective view of a facia or backing plate according to a fourteenth embodiment of the invention.
Figure 52:
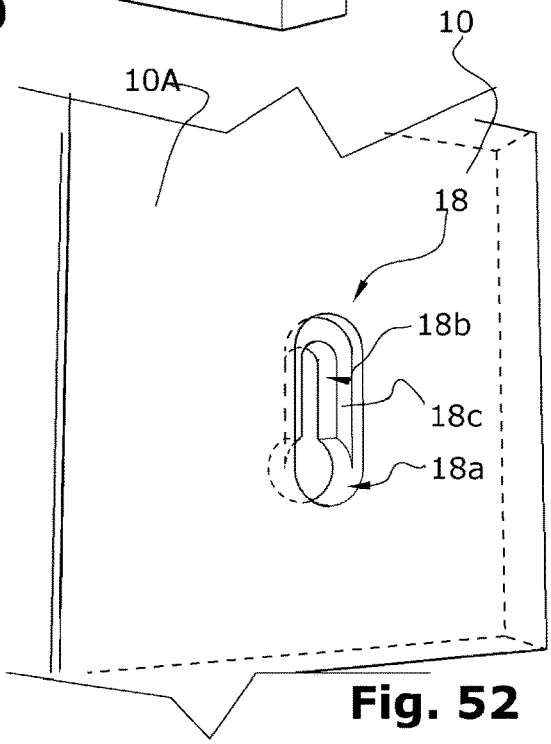
FIG. 52 is a front perspective view of the facia or backing plate according to the fourteenth embodiment of the invention.
Figure 53:
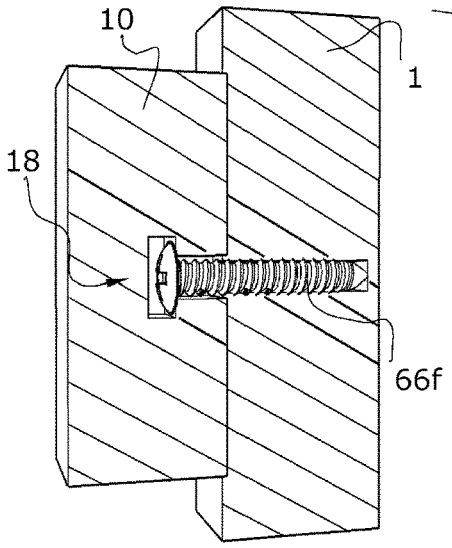
FIG. 53 is a cross-sectional view of the facia attached to a backing plate with a threaded screw according to the fourteenth embodiment of the invention.
Figure 54:
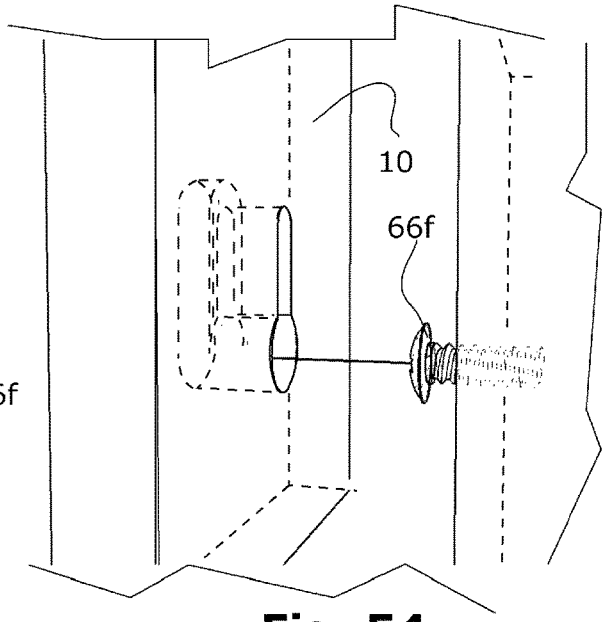
FIG. 54 is a partially exploded perspective view the facia, threaded screw and backing plate according to the fourteenth embodiment of the invention.
Figure 55:
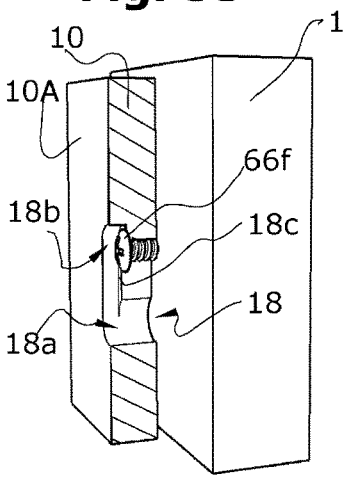
FIG. 55 is a cross-sectional view of the facia, threaded screw and backing plate according to the fourteenth embodiment of the invention.
Figure 56:
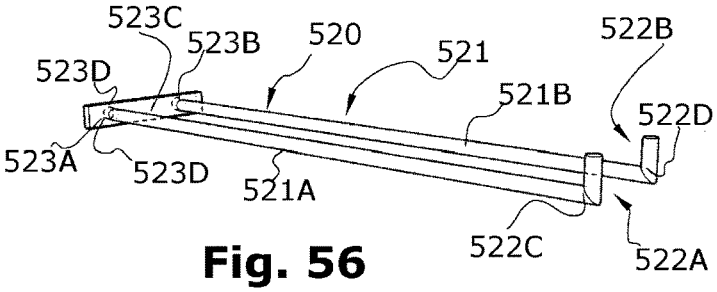
FIG. 56 is a perspective view of a wall-mounted stemmed glass holder according to a fifteenth embodiment of the invention.
Figure 57:
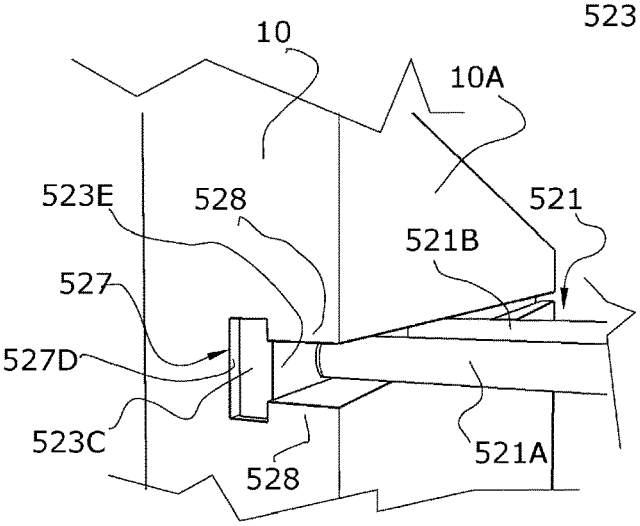
FIG. 57 is a perspective view of the wall-mounted stemmed glass holder slotted in a channel in a fascia panel according to the fifteenth embodiment of the invention.
Figure 58:
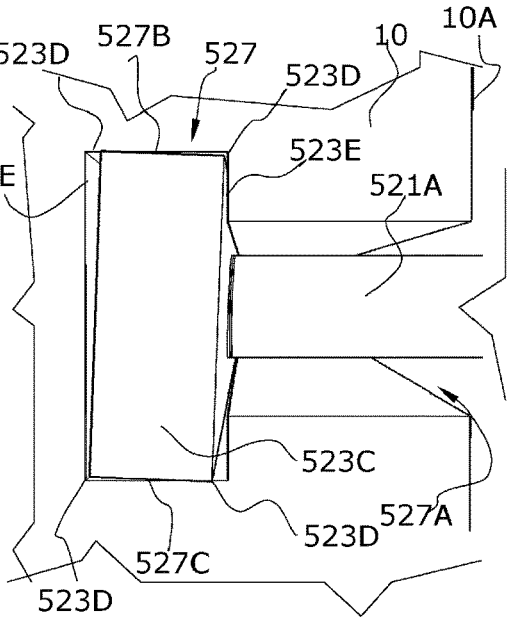
FIG. 58 is a side perspective view of the wall-mounted stemmed glass holder slotted in the channel in the fascia panel according to the fifteenth embodiment of the invention.
Figure 59:
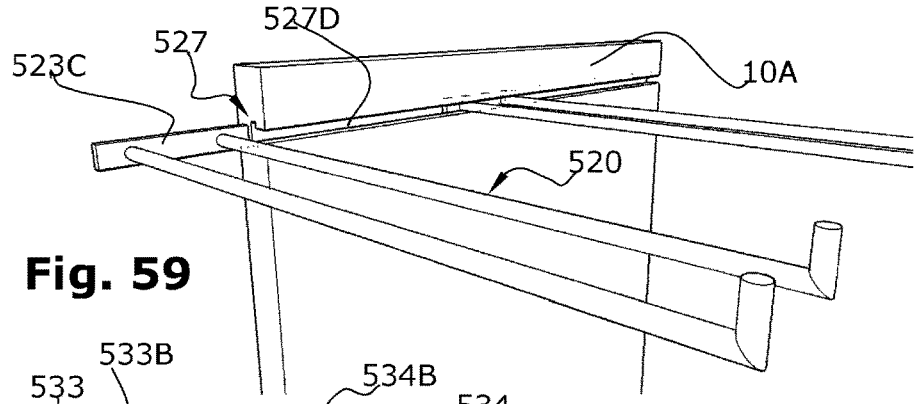
FIG. 59 is a perspective view of two of the wall-mounted stemmed glass holders and the fascia panel according to the fifteenth embodiment of the invention.
Figure 60:
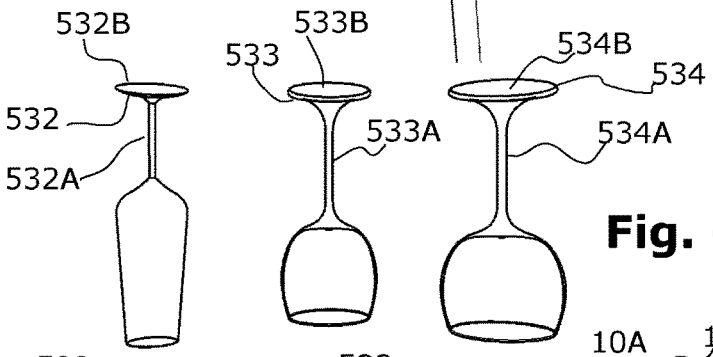
FIG. 60 is a front perspective view of three different types of stemmed glasses.

Alternatively, FIGS. 51 to 55 show the facia (10) having a keyhole (18) adapted to receive a threaded screw (66). The keyhole (18) and threaded screw (66) being the means to attach the facia to the wall (3*a*) or backing plate (1). The keyhole (18) includes a lower circular section (18*a*), an upper circular section (18*b*) and a step (18*c*). The keyhole (18) is adapted such that the threaded screw (66) is inserted into the lower circular section (18*a*) and then moved upwards to the upper circular section (18*b*). The threaded screw (66) is retained in the upper circular section (18*b*) with the step (18*c*) as seen in FIG. 51. The step (18*c*) is adapted to contact the head (66*e*) of the threaded screw (66). The keyhole (18) has a depth less than the thickness of the facia (10). The keyhole (18) only extends part way through the fascia (10).

FIGS. 56 to 61 show an embodiment of the invention including a kit for mounting a wall-mounted stemmed glass holder (520) adapted to hold a plurality of stemmed glasses (532-534) in display formation. The kit comprises a fascia panel (10) and a stemmed glass holder (520). The stemmed glass holder (520) formed from an elongate member (521A-B) able to be moulded, drawn or bent into a shape to support a stemmed glass (532-534). The elongate member (521A-B) is able to be mounted on the fascia panel (10) so that the stemmed glass holder (520) extends outwardly from an exposed fascia surface (10A). Wherein the kit further comprises a template to guide a user to locate a plurality of holes for securing a corresponding plurality of fasteners to a substrate. The elongate member (521A-B) terminating substantially co-extensively at free ends (522A-B) and having a cradle intermediate the length of the elongate member (521A-B). The elongate member (521A-B) including an elongate section (521) extending away from the fascia surface (10A) and, together with a bridge, adapted to support a stemmed glass (532-534) of any one of a variety of sizes in substantially vertical alignment. Supported ends (523A-B) of the elongate members (521A-B) including features (523C), which are adapted to slot into a channel (527) in the fascia panel (10).

Figure 61:
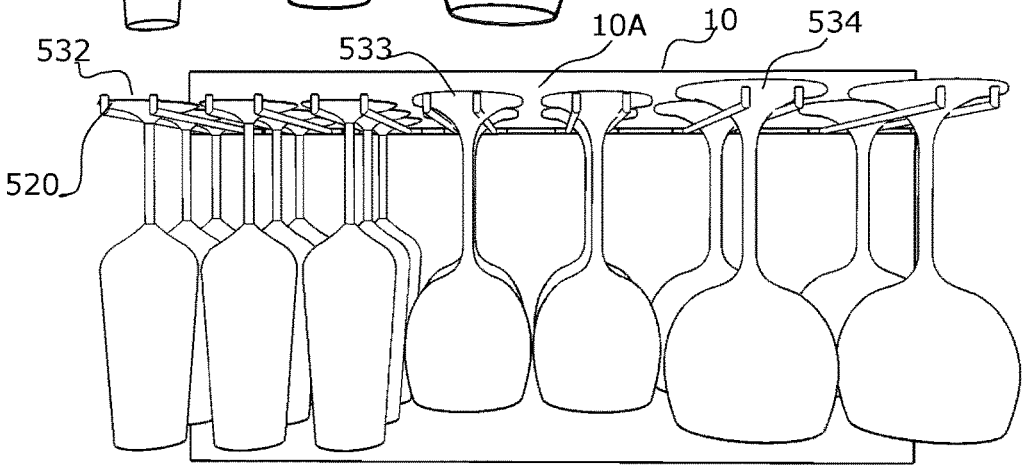
FIG. 61 is a front perspective view of the stemmed glasses supported by multiple wall-mounted stemmed glass holders slotted into the fascia panel according to the fifteenth embodiment of the invention.
Figure 62:
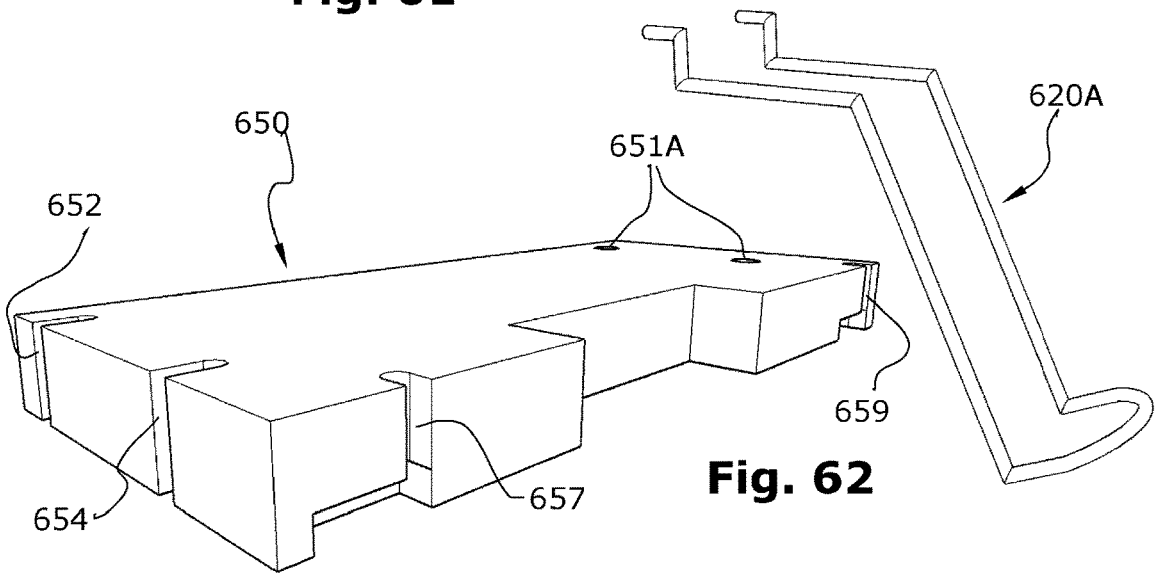
FIGS. 62 to 65 are perspective views of a block for accurate drilling of holes into a facia panel and bottle holders according to a sixteenth embodiment of the invention.
Figure 63:
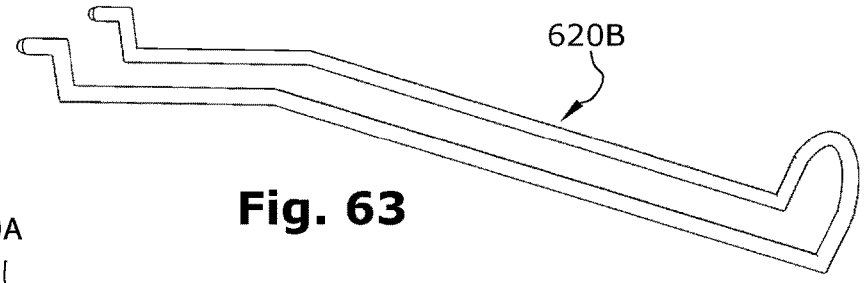
Figure 64:
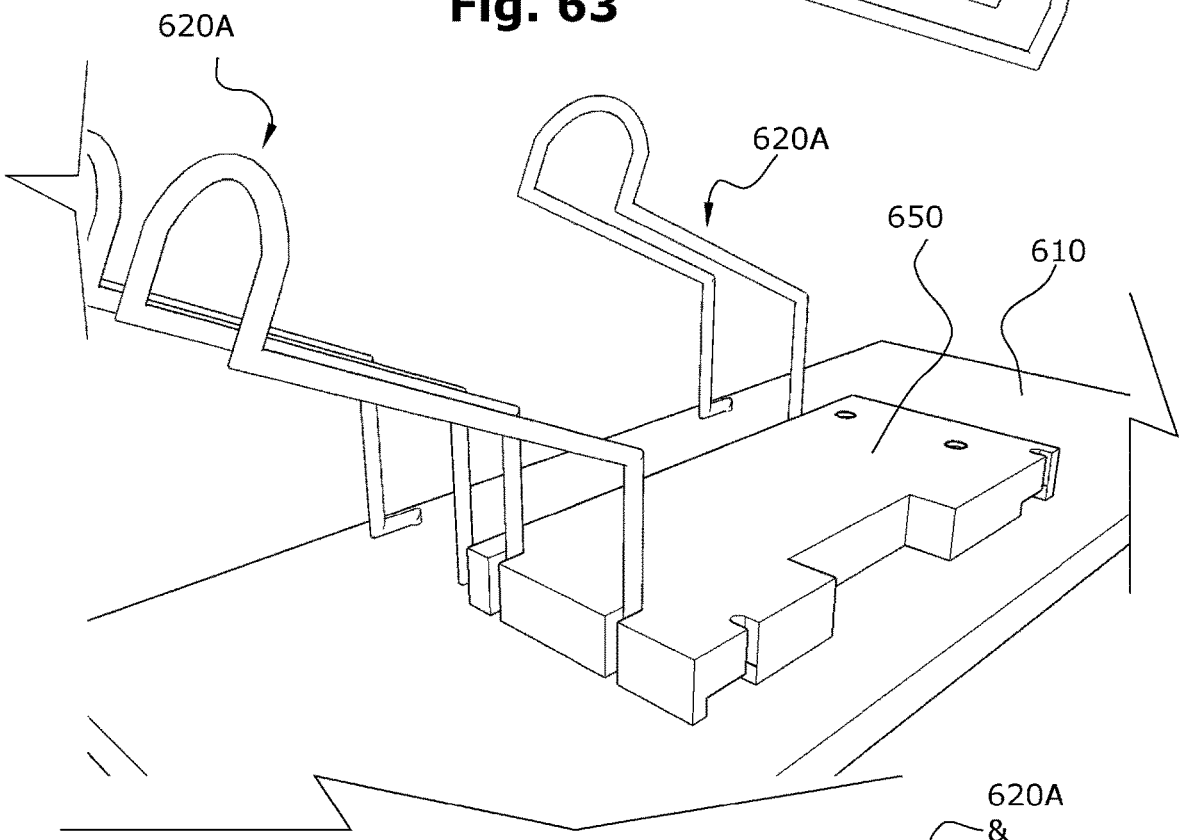

The stemmed glass holder (520) includes two elongate members (521A-B). The free ends (522A-B) including bends (522C-D). As seen in FIG. 61, the two elongate members (521A-B) are adapted such that a stem (532A, 533A, 534A) of the stemmed glass (532-534) can slot in between the elongate members (521A-B) and a base (532B, 533B, 534B) can then sit on the elongate members (521A-B). Therefore, the elongate members (521A-B) are adapted to support the stemmed glass (532-534).

Preferably, the bends (522C-D) angle the free ends (522A-B) between 60 to 90 degrees from the elongate section (521). The bends (522C-D) prevent stemmed glasses (532-534) from unintentionally sliding off the stemmed glass holder (520). The features (523C) include a plate (523C) welded to the elongate section (521). The plate (523C) is welded with a longitudinal axis of the elongate section (521) perpendicular to large faces (523E) of the plate (523C).

The channel (527) is a T-shaped channel (527) including an open end (527A) and two closed ends (527B-C). When the plate (523C) is inserted into the T-shaped channel, the stemmed glass holder (520) is captured and held in place by the material (528) of the fascia (10) between the two closed ends (527B-C) and the fascia surface (10A). The material (528) needs to be at least 3 mm thick to maintain its structural integrity while holding the stemmed glass holder (520). The gap between the plate (523C) and the T-shaped channel (527) may be less than 1 mm, or may be less than 0.1 mm. The plate (523C) may be a press fit into the T-shaped channel (527). The longitudinal edges (523D) of the plate (523C) are adapted to contact the internal surfaces (527D) of the T-shaped channel (527). The large faces (523E) of the plate (523C) are adapted to contact the internal surfaces (527D) of the T-shaped channel (527).

Figure 65:
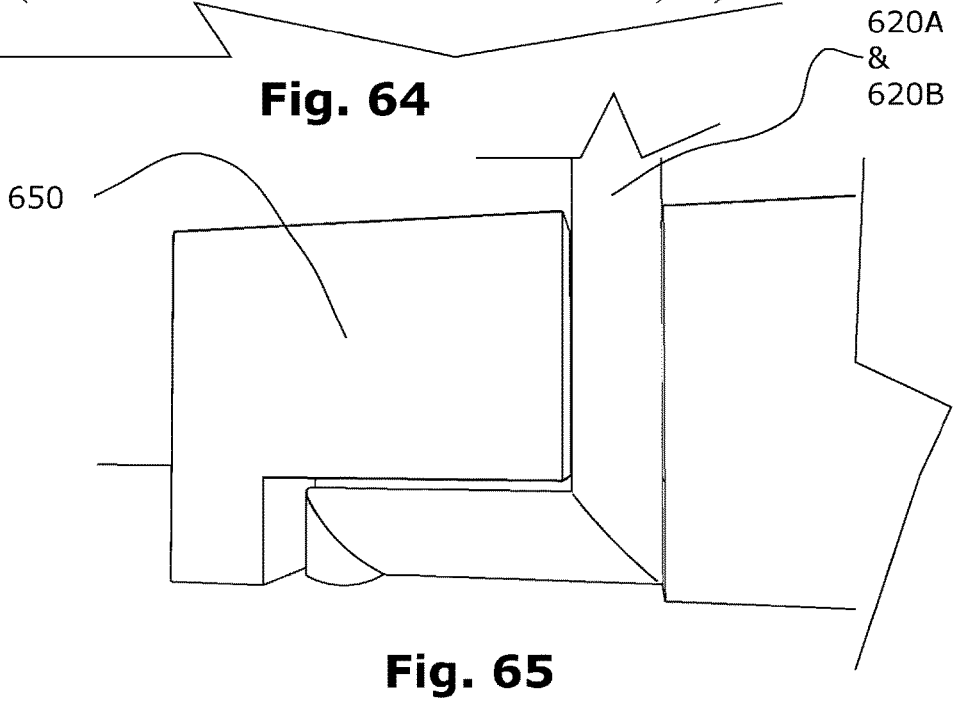

As seen in FIG. 65, the plates (523C) may be positioned at different locations along the length of the T-shaped channel (527) to accommodate stemmed glasses (532-534) with different diameters. Therefore, maximising the number of stemmed glasses, which can be held on the wall-mounted stemmed glass holder (520).

FIGS. 62-65 show a sixteenth embodiment of the invention in which the structure and function of bottle holders 620A,B and blocks (650) are applicable and substitutable, respectively, in relation to the other bottle holders (x20) and blocks (x50) described herein. Bottle holders 620A,620B are adapted to be mounted to holes in a facia panel 610. The bottle holders 620A,620B are inserted into the holes 611 in the facia panel 610 using supporting recesses 652, 658,654, 657,659 on the block 650 to provide support for the bottle holders. The recesses 652, 654, 657, 659 are used to position the template block 650 on the positioned holders in order to accurately drill the next positioned bottle holder holes 611.

The block 650 is also adapted to support the bottle holders 620A,B as they are inserted and into the holes in the facia panel 610. The bottle holders 620A,B are press fit into the facia panel 610 while the block 650 keeps spigots 622 of the bottle holders 620 coaxial with the holes in the facia panel 610. Advantageously, this protects the holes from damage due to misalignment of the spigots 622 with the holes as the bottle holders 620A,B are inserted into the holes in the facia panel 610.

Figure 66:
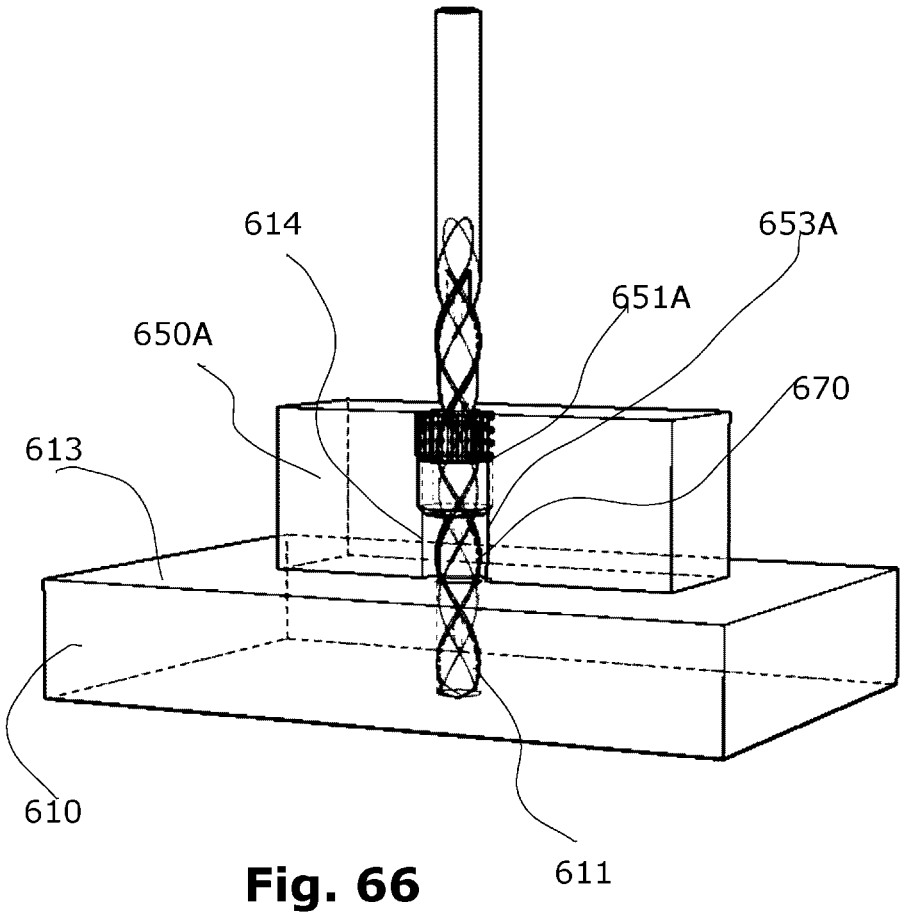
FIG. 66 is a cross-sectional view of a hardened drilling bush in a block with a drill bit drilling into a facia panel according to the seventeenth embodiment of the invention.
Figure 67:
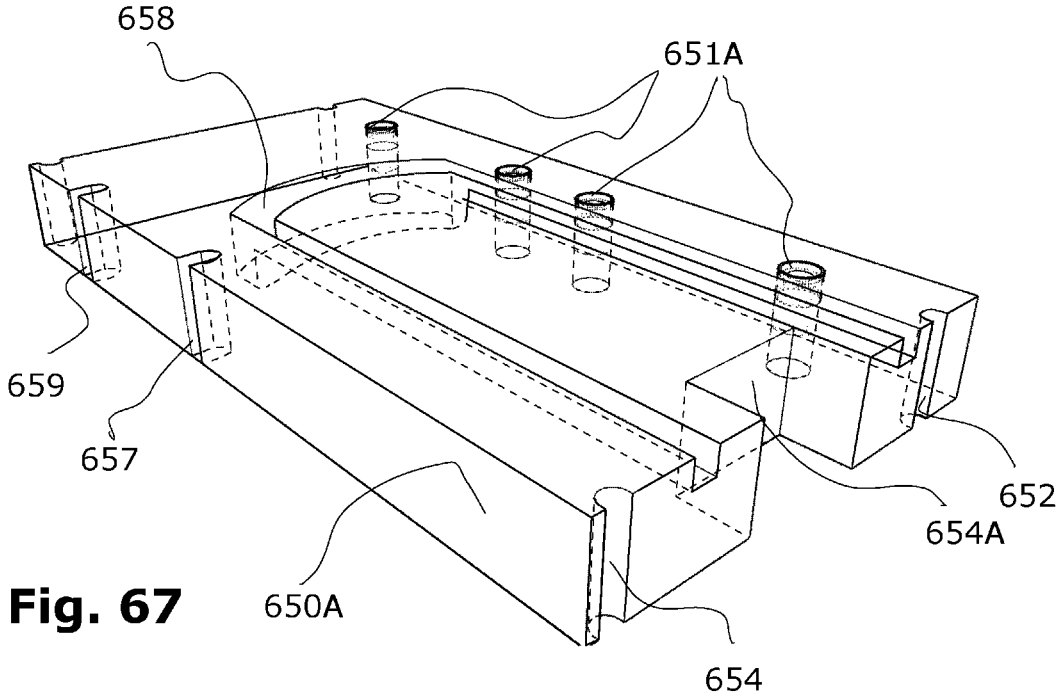
FIG. 67 is a perspective view of the block according to the seventeenth embodiment of the invention.

FIGS. 66 and 67 show the block 650A,650 with additional hardened drilling bushes 651A which are used as templates to accurately space the holes 611 in the facia panel 610 from each other. The drilling bushes include internal dimensions to closely fit a drill bit 670 of the correct size for the holes 611 in the facia panel 610. The hardened drilling bushes 651A are located in bush holes 653A offset from a front face 613 of the facia panel 610. The offset creates a gap 614 between the hardened drilling bushes and the front face of the facia panel 610 when drilling the holes 611 in the facia panel with the drill bit. This gap 614 provides space to receive sawdust from drilling the holes 611. The hardened drilling bush is also adapted to maintain the drill bit at a 90 degree angle to the front face of the facia panel during drilling. The block 650A further includes an alignment recess 654A which is adapted to line up with and edge of the facia panel 610 for positioning of the block 650A during drilling of the holes 611.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise. In the present specification, terms such as "apparatus", "means", "device" and "member" may refer to singular or plural items and are terms intended to refer to a set of properties, functions or characteristics performed by one or more items or components having one or more parts. It is envisaged that where an "apparatus", "means", "device" or "member" or similar term is described as being a unitary object, then a functionally equivalent object having multiple components is considered to fall within the scope of the term, and similarly, where an "apparatus", "assembly", "means", "device" or "member" is described as having multiple components, a functionally equivalent but unitary object is also considered to fall within the scope of the term, unless the contrary is expressly stated or the context requires otherwise. In the present specification, the phrase "and/or" refers to severally or any combination of the features. For example, the phrase "feature 1, feature 2 and/or feature 3" includes within its scope any one of the following combinations: Feature 1 or feature 2 or feature 3; feature 1 and feature 2 or feature 3; feature 1 or feature 2 and feature 3; feature 1 and feature 2 and feature 3.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the loop of the supporting arms extending outermost from the wall mounting.

The meaning of descriptive, precise or absolute terms such as "flexed", "normal", "parallel", "horizontal", "vertical" or "fully" includes the preceding qualifier "substantially or almost", unless the context or contrary is expressly indicated. Qualifying relative terms, such as "relatively", "sufficiently", "near", "marginally, "virtually", "almost" or "substantially", may be taken to indicate a variation in an absolute value of between 0° and 10° or between 0% and 10%, relative to the absolute value. For example, "near horizontal" may be taken to mean any orientation between 0° and 10° relative to the horizontal.

In the present specification, the term "integral" means formed of one body in a single process. In particular, the term "integrally formed" means formed of the one body without post-forming attachment of separately formed component parts. That is, "integrally formed" and the similar term "unitarily formed" mean formed in a single forming process and do not include post-forming attachment of component parts by means of fastener or other component fixing substances or methods.

It will be appreciated by those skilled in the art that many modifications and variations may be made to the methods of the invention described herein without departing from the spirit and scope of the invention. The invention can be described in terms of provisional claims that can assist the skilled reader in understanding the various aspects and preferments of the invention. However, these provisional claims are not to be construed as defining statements of the invention. It will be appreciated that other forms, aspects and preferred features of the invention and its embodiments described herein may ultimately be included in the claims defining the invention in the specifications of complete, international or national applications (or their subsequent corresponding patent grants) that may claim priority from the provisional application accompanying this specification. In this context, the following non-limiting claims assist to better describe the invention.

The invention claimed is:

1. A kit for mounting a wall-mounted bottle holder adapted to hold a plurality of bottles in display formation, the kit comprising:

a fascia panel; and a bottle holder comprising an elongate member to be mounted on the fascia panel so that the bottle holder extends outwardly from an exposed fascia surface, wherein the kit further comprises:

a template to guide a user to locate a plurality of holes for securing a corresponding plurality of fasteners to a substrate; and a removable block for facilitating the mounting of the bottle holder to the fascia panel, the elongate member terminating substantially co-extensively at free ends and having a cradle intermediate the length of the elongate member, the elongate member including a pair of elongate sections extending away from the fascia surface and, together with a bridge, adapted to support a bottle of any one of a variety of sizes in substantially horizontal alignment;

the removable block adapted to support the pair of elongate sections of the elongate member along or adjacent the free ends, and to maintain the linear integrity of the free ends, whilst force is applied to the bottle holder in the direction of the free ends and substantially parallel to the longitudinal axes of the elongate sections; and the block includes a pair of rigidly joined and spaced recessed grooves adapted to receive the elongate sections of the elongate member, the block partially encasing the elongate sections, substantially between the free ends and the bridge, but not the free ends.

2. The kit as claimed in claim 1, further comprising a backing plate adapted to independently attach to the substrate and to support the fascia panel interposed between the substrate and the fascia panel.

3. The kit as claimed in claim 2, wherein a mounting template includes the template and the backing plate as part of the same.

4. The kit as claimed in claim 1, wherein the fascia panel includes, on its rear side, at least one pre-formed recess substantially in the shape of a keyhole or a cylinder with a rectangular prism connected that is adapted to receive a mounting fastener head, including a threaded screw head, or a spacer, the spacer held in place with a mounting fastener.

5. The kit as claimed in claim 1, wherein the fascia panel is the first of two or more fascia panels.

6. The kit as claimed in claim 1, wherein the length: diameter ratio of the free ends adapted to extend from the block is between 5:1 and 2:1.

7. The kit as claimed in claim 1, wherein the pair of elongate sections include the bridge and the block is adapted to receive the bridge.

8. The kit as claimed in claim 1, wherein the spaced recessed grooves are correspondingly joined by a connecting curved recess to correspond to the bridge which is curved.

9. The kit as claimed in claim 8, wherein the curved recess is defined by a load bearing surface and a passive wall surface, and the spaced recessed grooves comprise parallel side wall surfaces.

10. The kit as claimed in claim 8, wherein the curved recess provides a generally laterally extending recess within the block that is adapted to be in contact with an upper face of the bridge.

11. The kit as claimed in claim 1, wherein the pair of elongate sections each have longitudinal axes and the load-bearing surface allows force to be directionally applied to focus the force along the longitudinal axes.

12. The kit as claimed in claim 1, wherein the free ends extend beyond open ends of the spaced recessed grooves and are configured to be driven into holes aligned in registration in the fascia panel.

13. The kit as claimed in claim 12, wherein the width and length of the free ends is dimensioned such that, on correct registration of the free ends to the holes in the fascia panel, resistance provided by the holes to entry of the free ends is insufficient to provide a compressive force along axes for the linear free ends to buckle or bend transverse to the longitudinal axes.

14. The kit as claimed in claim 12, wherein the diameter of the holes in the facia panel are sized to be equal to or less than the diameter of the free ends.

15. The kit as claimed in claim 1, wherein the free ends are formed with a wire section and the bridge is in the form of a cradle adapted to support a body of the bottle.

* * * * *